US012228127B2

(12) United States Patent
Hurst et al.

(10) Patent No.: US 12,228,127 B2
(45) Date of Patent: Feb. 18, 2025

(54) PUMP FLUID END WITH SUCTION VALVE CLOSURE ASSIST

(71) Applicant: Halliburton Energy Services, Inc., Houston, TX (US)

(72) Inventors: Justin Lee Hurst, Duncan, OK (US); David Mark Stribling, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/538,373

(22) Filed: Dec. 13, 2023

(65) Prior Publication Data

US 2024/0110550 A1 Apr. 4, 2024

Related U.S. Application Data

(60) Division of application No. 17/667,669, filed on Feb. 9, 2022, now Pat. No. 11,885,316, which is a (Continued)

(51) Int. Cl.

| | |
|---|---|
| ***F04B 7/02*** | (2006.01) |
| ***F04B 53/10*** | (2006.01) |
| ***F04B 53/12*** | (2006.01) |

(52) U.S. Cl.

CPC ..... *F04B 7/0266* (2013.01); *F04B 53/1085* (2013.01); *F04B 53/12* (2013.01)

(58) Field of Classification Search

CPC .... F04B 7/0266; F04B 53/1085; F04B 53/12; F04B 39/08; F04B 53/125; F04B 53/127; (Continued)

(56) References Cited

U.S. PATENT DOCUMENTS

| | | | |
|---|---|---|---|
| 1,294,014 | A | 2/1919 | Worster |
| 1,662,725 | A | 3/1928 | Toney |

(Continued)

FOREIGN PATENT DOCUMENTS

| | | | |
|---|---|---|---|
| CH | 257522 | A | 12/1948 |
| DE | 19808724 | A1 | 9/1998 |

(Continued)

OTHER PUBLICATIONS

Foreign Communication from Related Application—International Search Report and Written Opinion of the International Searching Authority, International Application No. PCT/US2020/022043, dated Jul. 3, 2020, 13 pages.

(Continued)

*Primary Examiner* — Bryan M Lettman

(74) *Attorney, Agent, or Firm* — Conley Rose, P.C.; Rodney B. Carroll

(57) ABSTRACT

A pump fluid end having a reciprocating element a discharge valve assembly, a suction valve assembly, and a suction valve stop. The reciprocating element is disposed at least partially within a reciprocating element bore of the pump fluid end. The suction valve assembly is coupled with a front end of the reciprocating element. The suction valve stop is (Continued)

positioned within the reciprocating element bore such that the suction valve stop contacts and applies a closing force to the suction valve assembly when the suction valve assembly is stuck open at the end of a discharge stroke of the reciprocating element.

10 Claims, 7 Drawing Sheets

Related U.S. Application Data continuation of application No. 16/436,312, filed on Jun. 10, 2019, now Pat. No. 11,280,326.

(58) Field of Classification Search
CPC .. F04B 53/129; F04B 53/1035; F04B 7/0053; F04B 7/0042; F04B 7/0057; F04B 7/0069; F04B 53/102; F04B 53/1022; F04B 53/103; F04B 53/1032; F04B 39/10; F04B 39/1013; F04B 39/102; F04B 47/00; F04B 47/02; F04B 47/12; F04B 15/02
USPC ..... 417/549, 552, 570
See application file for complete search history.

(56) References Cited

U.S. PATENT DOCUMENTS 2,673,519 A 3/1954 Halliburton
2,678,006 A 5/1954 Gray
3,005,412 A 10/1961 Camp
3,229,640 A 1/1966 Williams
3,299,417 A 1/1967 Sibthorpe
3,301,197 A 1/1967 Dodson
3,380,247 A 4/1968 Colmerauer
3,516,434 A 6/1970 Noss
3,664,371 A 5/1972 Schneider
3,887,305 A 6/1975 Ito
4,341,235 A 7/1982 Nord
4,478,561 A 10/1984 Elliston
4,541,779 A * 9/1985 Birdwell ..... F04B 15/02 417/454
4,784,588 A 11/1988 Miyashita et al.
4,850,392 A 7/1989 Crump et al.
4,939,923 A 7/1990 Sharp
5,040,408 A 8/1991 Webb
5,061,159 A 10/1991 Pryor
5,072,622 A 12/1991 Roach et al.
5,141,411 A * 8/1992 Klaeger ..... F04B 47/02 417/450
5,176,025 A 1/1993 Butts
5,343,738 A 9/1994 Skaggs
5,403,168 A 4/1995 Evenson
5,720,325 A 2/1998 Grantham
5,924,853 A 7/1999 Pacht
6,032,699 A 3/2000 Cochran et al.
6,082,392 A 7/2000 Watkins, Jr.
6,164,188 A 12/2000 Miser
6,342,272 B1 1/2002 Halliwell
6,607,010 B1 8/2003 Kashy
6,702,557 B2 3/2004 Kim et al.
6,935,161 B2 8/2005 Hutchinson
7,798,165 B2 9/2010 McClung, Jr.
8,234,911 B2 8/2012 Jax
8,360,751 B2 1/2013 Duncan
8,366,408 B2 3/2013 Wago et al.
8,418,363 B2 4/2013 Patel
8,506,262 B2 8/2013 Leugemors et al.
8,550,102 B2 10/2013 Small
8,590,614 B2 11/2013 Surjaatmadja et al.
9,499,895 B2 11/2016 Langan et al.
9,528,508 B2 12/2016 Thomeer et al.
9,617,654 B2 4/2017 Rajagopalan et al.
9,822,894 B2 11/2017 Bayyouk et al.
10,677,380 B1 6/2020 Surjaatmadja et al.
10,808,846 B1 10/2020 Hurst et al.
10,808,851 B1 10/2020 Surjaatmadja et al.
10,941,766 B2 3/2021 Hurst et al.
10,989,188 B2 4/2021 Surjaatmadja et al.
11,261,863 B2 3/2022 Beisel et al.
11,280,326 B2 3/2022 Hurst et al.
11,441,687 B2 9/2022 Hurst et al.
11,739,748 B2 8/2023 Hurst et al.
11,885,316 B2 1/2024 Hurst et al.
2007/0044848 A1 3/2007 Norman
2007/0267076 A1 11/2007 Strauss et al.
2008/0011057 A1 1/2008 Spaolonzi et al.
2009/0041588 A1 2/2009 Hunter et al.
2009/0041596 A1 2/2009 Ponomarev et al.
2009/0159133 A1 6/2009 Popke et al.
2009/0194174 A1 8/2009 Morgan et al.
2009/0246051 A1 10/2009 Kim
2009/0252616 A1 10/2009 Brunet et al.
2009/0278069 A1 11/2009 Blanco et al.
2010/0098568 A1 4/2010 Marica
2010/0126250 A1 5/2010 Jax
2011/0180740 A1 7/2011 Marica
2012/0148431 A1 6/2012 Gabriel
2012/0223267 A1 9/2012 Marica
2012/0279721 A1* 11/2012 Surjaatmadja ..... F04B 53/10 166/105
2012/0312402 A1 11/2012 Tyler
2013/0061942 A1 3/2013 Hulsey
2013/0319220 A1 12/2013 Luharuka et al.
2014/0064996 A1 3/2014 Arima
2014/0127036 A1 5/2014 Buckley et al.
2014/0127058 A1 5/2014 Buckley et al.
2014/0127062 A1 5/2014 Buckley et al.
2014/0150889 A1 6/2014 Ragner
2014/0261790 A1 9/2014 Marica
2014/0312257 A1 10/2014 Marica
2014/0322050 A1 10/2014 Marette et al.
2014/0328701 A1 11/2014 Nathan
2014/0348677 A1 11/2014 Moeller et al.
2015/0132157 A1 5/2015 Whaley et al.
2015/0361745 A1 12/2015 Guerra
2016/0131131 A1 5/2016 Weaver et al.
2016/0131264 A1 5/2016 Bregazzi et al.
2016/0215588 A1 7/2016 Belshan et al.
2016/0281699 A1 9/2016 Gnessin et al.
2016/0319805 A1 11/2016 Dille
2017/0090457 A1 3/2017 Pandurangan et al.
2017/0107979 A1 4/2017 Hilgers et al.
2018/0030969 A1 2/2018 Nong
2018/0058431 A1 3/2018 Blume
2018/0058444 A1 3/2018 Blume
2018/0298894 A1 10/2018 Wagner et al.
2019/0120389 A1 4/2019 Foster et al.
2019/0145391 A1 5/2019 Davids
2019/0226475 A1 7/2019 Stark et al.
2020/0347706 A1 11/2020 Nowell et al.
2020/0362851 A1 11/2020 Beisel et al.
2020/0362853 A1 11/2020 Hurst et al.
2020/0362855 A1 11/2020 Beisel et al.
2020/0362856 A1 11/2020 Hurst et al.
2020/0362970 A1 11/2020 Hurst et al.
2020/0362971 A1 11/2020 Hurst et al.
2020/0386214 A1 12/2020 Hurst et al.
2020/0386223 A1 12/2020 Hurst et al.
2021/0025385 A1 1/2021 Surjaatmadja et al.

FOREIGN PATENT DOCUMENTS

EP 0580196 A1 1/1994
EP 1103722 A2 5/2001
EP 2383470 A1 2/2011
GB 120622 A 11/1918
GB 450645 A 7/1936
GB 672173 A 5/1952
GB 1226014 A 3/1971
GB 1262826 A 2/1972
JP 63001012 Y2 1/1988

(56) References Cited

FOREIGN PATENT DOCUMENTS

| | | | |
|---|---|---|---|
| JP | 2002037217 | A | 2/2002 |
| JP | 2004257283 | A | 9/2004 |
| JP | 4121804 | B2 | 7/2008 |
| JP | 2009131747 | A | 6/2009 |
| JP | 5107651 | B2 | 12/2012 |
| JP | 2020040010 | A | 3/2020 |
| WO | 2020251564 | A1 | 12/2020 |
| WO | 2020251640 | A1 | 12/2020 |
| WO | 2021021138 | A1 | 2/2021 |
| WO | 2021021139 | A1 | 4/2021 |

OTHER PUBLICATIONS

Foreign Communication from Related Application—International Search Report and Written Opinion of the International Searching Authority, International Application No. PCT/US2020/022067, dated Jul. 3, 2020, 13 pages.

Romer, M. C. et al., "Field Trial of a Novel Self-Reciprocating Hydraulic Pump for Deliquification," SPE Production & Operations, 2017, 12 pages, Society of Petroleum Engineers.

Houghton, J.E. et al., "Improved Pump Run Time Using Snow Auto-Rotating Plunger (SARP) Pump," SPE Western Regional Meeting, May 1998, SPE46217, 6 pages, Society of Petroleum Engineers, Inc.

"Improved Double Acting Pump," Scientific American, 1867, pp. 248, vol. 17, No. 16, American Periodicals.

Pump Catalog, Cat Pumps, Inc., 2014, 24 pages.

Furuta, Katsunori et al., "Study of the In-Line Pump System for Diesel Engines to Meet Future Emission Regulations," SAE International Congress and Exposition, Feb. 1998, pp. 125-136, Society of Automotive Engineers, Inc.

Langewis, Jr., C. et al., "Practical Hydraulics of Positive Displacement Pumps for High-Pressure Waterflood Installations," Journal of Petroleum Technology, Feb. 1971, pp. 173-179, SPE-AIME/Continental Oil Co.

"550 Series: High Pressure, High Flow Water Jetting," Gardner Denver Water Jetting Systems, Inc., 2009, 4 pages.

Petzold, Martin et al., "Visualization and Analysis of the Multiphase Flow in an Electromagnetically Driven Dosing Pump," ASME/BATH Symposium on Fluid Power & Motion Control, Oct. 2013, FPMC2013-4433, 6 pages, ASME.

Scully Intellicheck3, Complete Overfill Prevention and Retained Product Monitoring System, XXXXX Rev A, Jun. 2016, 2 pages.

Scully Intellicheck2, Complete Overfill Prevention and Retained Product Monitoring System, 67293 Rev B, May 2014, 2 pages.

Scully Intellicheck2, Complete Overfill Prevention and Retained Product Monitoring System, 67293 Rev B, Oct. 2013, 2 pages.

Kiani, Mahdi et al., "Numerical Modeling and Analytical Investigation of Autofrettage Process on the Fluid End Module of Fracture Pumps," Journal of Pressure Vessel Technology, Aug. 2018, pp. 0414031-0414037, vol. 140, ASM.

* cited by examiner

PUMP FLUID END WITH SUCTION VALVE CLOSURE ASSIST

CROSS-REFERENCE TO RELATED APPLICATIONS

This application is a Divisional of and claims priority to U.S. patent application Ser. No. 17/667,669 filed Feb. 9, 2022 and published as U.S. Patent Application Publication No. 2022/0154705 A1, which is a Continuation of and claims priority to U.S. patent application Ser. No. 16/436,312 filed Jun. 10, 2019 now U.S. Pat. No. 11,280,326 B2, each entitled "Pump Fluid End with Suction Valve Closure Assist," each of which are hereby incorporated by reference in their entirety.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present disclosure relates generally to a method and apparatus for supplying pressurized fluids. More particularly, the present disclosure relates to methods and reciprocating devices for pumping fluids into a wellbore.

BACKGROUND

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations. As fluids pumped by such pumps often contain particulates, the pumps must be designed for operation in the presence of such particulate material.

Accordingly, it is desirable to provide a pump fluid end that enables operation of the pump in the presence of particulate material. Desirably, such a pump fluid end facilitates removal of a particulate material that has become lodged within a suction valve assembly at the end of a discharge stroke of the pump, thereby ensuring closure of the suction valve.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
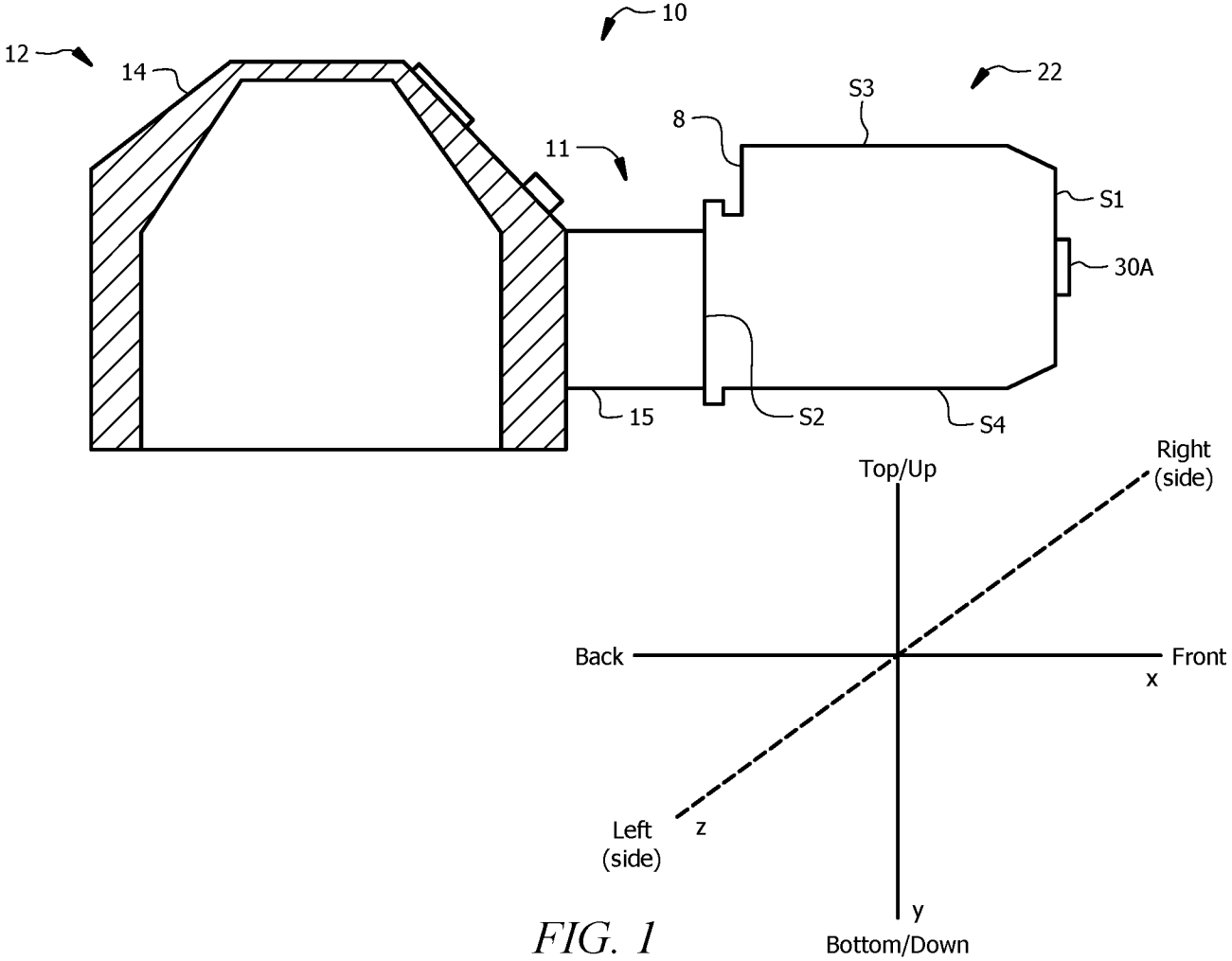
FIG. 1 is an elevational view of a reciprocating pump, according to embodiments of this disclosure.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Pump suction valves can become stuck in an open configuration when pumping fluids containing large particles (also referred to herein as particulates or particulate material), such as and without limitation, drill cuttings, rocks, sand, fluid diverter, and the like. This generally occurs when the full open position (e.g., an opening distance between a suction valve body (e.g., a moveable poppet) and a suction valve seat 58 of a suction valve assembly, which can be dependent on the pump rate and preload of a spring of the suction valve assembly) approximates the size to the size of the particles being pumped. Such particles/particulates will be referred to herein as "large" particles/particulates. In such instances, the suction valve assembly can get stuck open because the reciprocating element cannot create sufficient differential pressure to close the suction valve assembly (e.g., to force the suction valve body or poppet of the suction valve assembly into contact with the suction valve seat of the suction valve assembly), or create enough flow across the suction valve assembly to flush the stuck particulate material free. Generally, the suction valve assembly, not the discharge valve assembly, gets stuck open, because the discharge valve assembly experiences a larger pressure differential and a flow sufficient to prevent particulates from being stuck therein (e.g., stuck between a discharge valve body (e.g., a movable poppet) of the discharge valve assembly and a discharge valve seat of the discharge valve assembly).

Disclosed herein is a reciprocating apparatus for pumping pressurized fluid designed to prevent a suction valve assembly from being stuck in an open configuration at the end of a discharge stroke of a reciprocating element thereof. In embodiments, the reciprocating apparatus comprises a pump comprising a pump fluid end having a reciprocating element disposed at least partially within a reciprocating element bore of the pump fluid end; a discharge valve assembly; a suction valve assembly coupled with a front end of the reciprocating element; and a suction valve stop. The suction valve stop is positioned within the reciprocating element bore such that the suction valve stop contacts and applies a closing force to the suction valve assembly when the suction valve assembly is stuck open at the end of a discharge stroke of the reciprocating element. In embodiments, the reciprocating apparatus is a high-pressure pump configured to operate at a pressure greater than or equal to about 3,000 psi and/or in a well servicing operation and environment.

A reciprocating apparatus of this disclosure may comprise any suitable pump operable to pump fluid. Non-limiting examples of suitable pumps include, but are not limited to, piston pumps, plunger pumps, and the like. In embodiments, the pump is a rotary- or reciprocating-type pump such as a positive displacement pump operable to displace pressurized fluid. The pump comprises a pump power end, a pump fluid end, and an integration section whereby a reciprocating element (e.g., a plunger) can be mechanically connected with the pump power end such that the reciprocating element can be reciprocated within a reciprocating element bore of the pump fluid end. FIG. 1 is an elevational view (e.g., side view) of a pump 10 (e.g., a reciprocating pump) according to an exemplary embodiment, the reciprocating pump comprising a pump power end 12, a pump fluid end 22, and an integration section 11. As illustrated in FIG. 1, pump fluid end has a front S1 opposite a back S2 along a first or x-axis, a top S3 opposite a bottom S4 along a second or y-axis, wherein the y-axis is in the same plane as and perpendicular to the x-axis, and a left side and a right side along a z-axis, wherein the z-axis is along a plane perpendicular to the plane of the x-axis and the y-axis. Accordingly, toward the top of pump fluid end 22 (and pump 10) is along the y-axis toward top S3, toward the bottom of pump fluid end 22 (and pump 10) is along the y-axis toward bottom S4, toward the front of pump fluid end 22 (and pump 10) is along the x-axis toward front S1, and toward the back of pump fluid end 22 (and pump 10) is along the x-axis away from front S1.

Figure 2A:
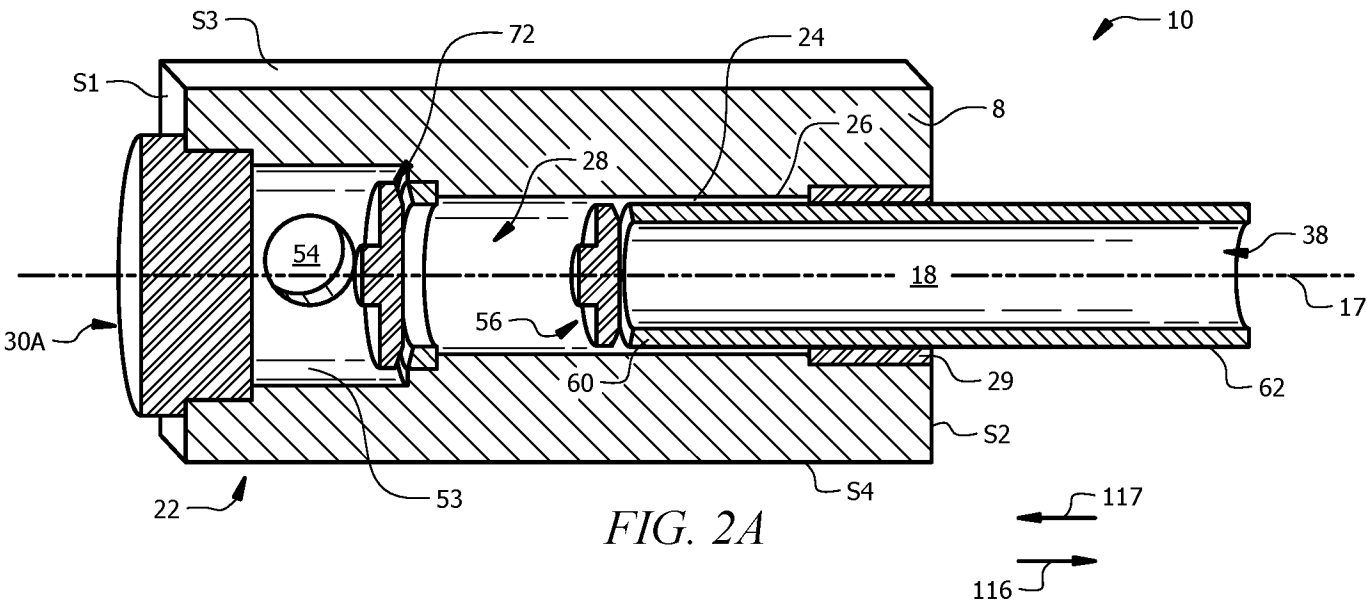
FIG. 2A is a cut-away illustration of an exemplary reciprocating pump comprising a concentric bore pump fluid end, according to embodiments of the present disclosure.
Figure 2B:
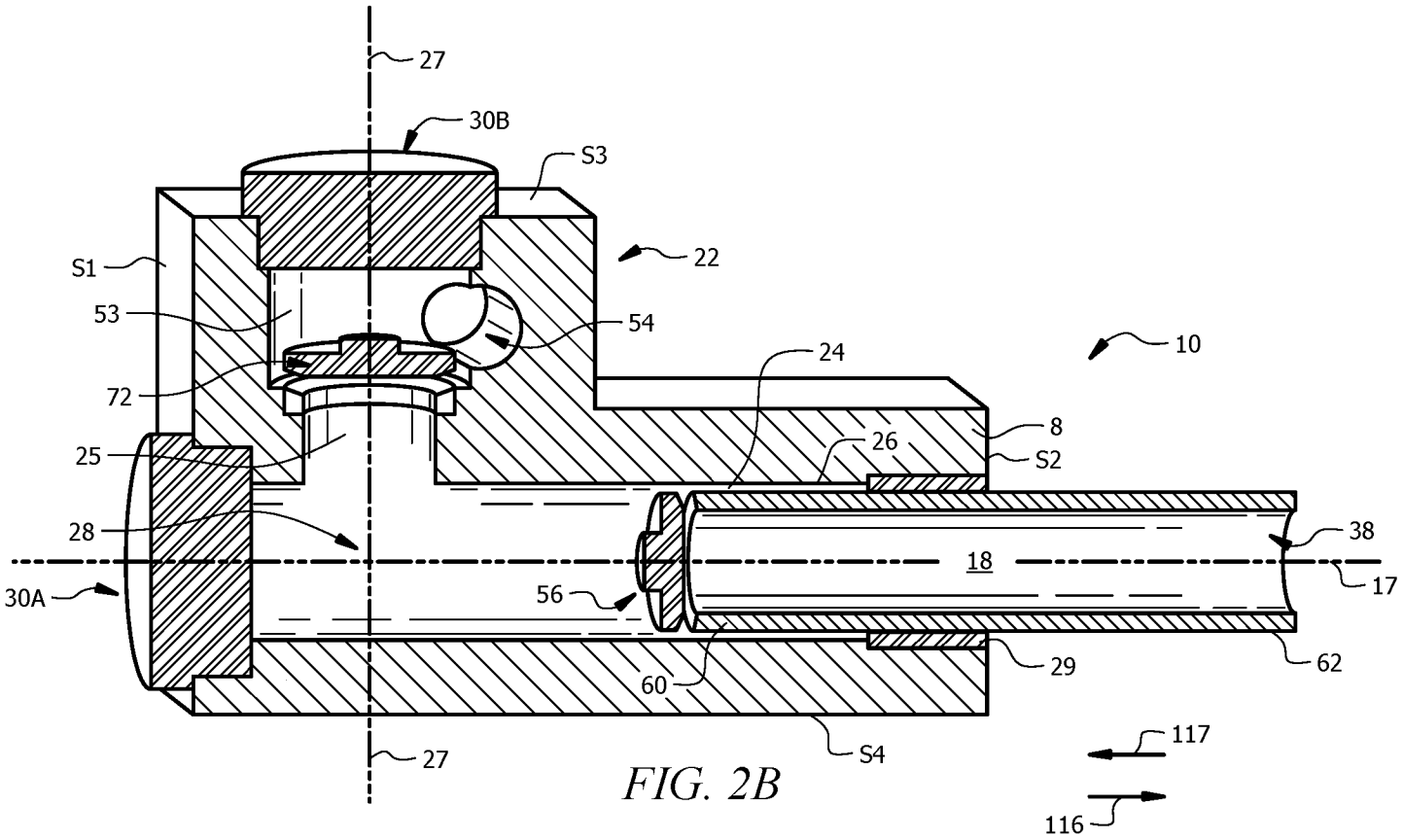
FIG. 2B is a cut-away illustration of an exemplary reciprocating pump comprising a cross-bore (e.g., a tee-bore ("T-bore")) pump fluid end, according to embodiments of the present disclosure.

The pump fluid end 22 is integrated with the pump power end 12 via the integration section 11, such that pump power end 12 is operable to reciprocate the reciprocating element 18 within a reciprocating element bore 24 (FIG. 2A/FIG. 2B) of the pump fluid end 22. The reciprocating element bore 24 is at least partially defined by a cylinder wall 26. As described further hereinbelow with reference to FIG. 2A, pump fluid end 22 of this disclosure can be an in-line or "concentric" bore pump fluid end. In alternative embodiments, described further hereinbelow with reference to FIG. 2B, pump fluid end 22 is a "cross-bore" pump fluid end 22, which, as utilized herein, can include "T-bore" pump fluid ends, "X-bore" (e.g., cross shaped bore) pump fluid ends, or "Y-bore" pump fluid ends. FIG. 2A is a schematic showing a concentric bore pump fluid end 22 engaged with a reciprocating element 18. FIG. 2B is a schematic showing a tee-bore pump fluid end 22 engaged with a reciprocating element 18. In a tee-bore pump fluid end 22, reciprocating element bore 24 and tee-bore 25 are perpendicular, making the shape of a "T". As discussed further below, the pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

The pump 10 may comprise any suitable pump power end 12 for enabling the pump 10 to perform pumping operations (e.g., pumping a wellbore servicing fluid downhole). Similarly, the pump 10 may include any suitable housing 14 for containing and/or supporting the pump power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the pump power end 12 and/or other pump components. As such, the pump 10 may be inspected to determine whether parts need to be repaired or replaced. The pump power end may also be hydraulically driven, whether it is a non-intensifying or an intensifying system.

Figure 3:
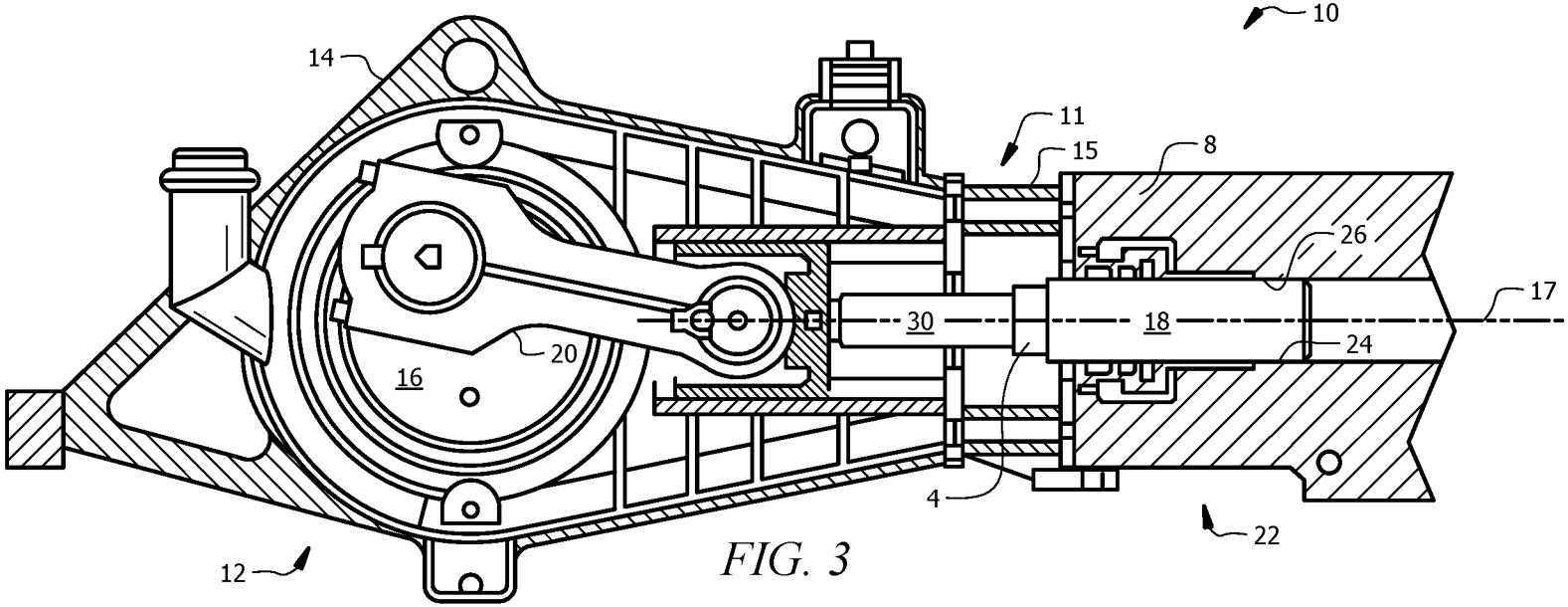
FIG. 3 is cut-away illustration of a pump power end of a pump, according to embodiments of the present disclosure.

Those versed in the art will understand that the pump power end 12 may include various components commonly employed in pumps. Pump power end 12 can be any suitable pump known in the art and with the help of this disclosure to be operable to reciprocate reciprocating element 18 in reciprocating element bore 24. For example, without limitation, pump power end 12 can be operable via and comprise a crank and slider mechanism, a powered hydraulic/pneumatic/steam cylinder mechanism or various electric, mechanical or electro-mechanical drives. FIG. 3 provides a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 attached to at least one reciprocating element 18 (e.g., a plunger or piston) by way of a crank arm 20 and pushrod 30. Additionally, an engine (e.g., a diesel engine), motor, or other suitable power source may be operatively connected to the crankshaft 16 (e.g., through a transmission and drive shaft) and operable to actuate rotation thereof. In operation, rotation of the crankshaft 16 induces translational movement of the crank arm rod 20, thereby causing the reciprocating element 18 to extend and retract along a flow path, which may generally be defined by a central axis 17 within a reciprocating element bore 24 (sometimes referred to herein for brevity as a "reciprocating element bore 24" or simply a "bore 24", and not wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising crankshaft 16 and related connecting rods 20).

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

As noted hereinabove, the pump 10 comprises a pump fluid end 22 attached to the pump power end 12. Various embodiments of the pump fluid end 22 are described in detail below in connection with other drawings, for example FIG. 2A and FIG. 2B. Generally, the pump fluid end 22 comprises at least one fluid inlet 38 for receiving fluid, and at least one discharge outlet 54 through which fluid flows out of the discharge chamber 53. The pump fluid end 22 also comprises at least one valve assembly for controlling the receipt and output of fluid. For example, the pump fluid end 22 can comprise a suction valve assembly 56 and a discharge valve assembly 72. The pump fluid end 22 may include any suitable component(s) and/or structure(s) for containing and/or supporting the reciprocating element 18 and providing a cylinder wall 26 at least partially defining a reciprocating element bore 24 along which the pump power end can reciprocate the reciprocating element during operation of the pump.

In embodiments, the pump fluid end 22 may comprise a cylinder wall 26 at least partially defining a bore 24 through which the reciprocating element 18 may extend and retract. Additionally, the bore 24 may be in fluid communication with a discharge chamber 53 formed within the pump fluid end 22. Such a discharge chamber 53, for example, may be configured as a pressurized discharge chamber 53 having a discharge outlet 54 through which fluid is discharged by the reciprocating element 18. Thus, the reciprocating element 18 may be movably disposed within the reciprocating element bore 24, which may provide a fluid flow path into and/or out of the pump chamber. During operation of the pump 10, the reciprocating element 18 may be configured to reciprocate along a path (e.g., along central axis 17 within bore 24 and/or pump chamber 28, which corresponds to reciprocal movement parallel to the x-axis of FIG. 1) to transfer a supply of fluid to the pump chamber 28 and/or discharge fluid from the pump chamber 28.

In operation, the reciprocating element 18 extends and retracts along a flow path to alternate between providing forward strokes (also referred to as discharge strokes and correlating to movement in a positive direction parallel to the x-axis of FIG. 1 and indicated by arrow 117 of FIG. 2A and FIG. 2B) and return strokes (also referred to as suction strokes and correlating to movement in a negative direction parallel to the x-axis of FIG. 1 and indicated by arrow 116 in FIG. 2A and FIG. 2B), respectively. During a forward stroke, the reciprocating element 18 extends away from the pump power end 12 and toward the pump fluid end 22. Before the forward stoke begins, the reciprocating element 18 is in a fully retracted position (also referred to as bottom dead center (BDC) with reference to the crankshaft 16), in which case the suction valve assembly 56 can be in a closed configuration having allowed fluid to flow into the (e.g., high pressure) pump chamber 28. When discharge valve assembly 72 is in a closed configuration (e.g., under the influence of a closing mechanism, such as a spring, the high pressure in a discharge pipe or manifold containing discharge outlet 54) prevents fluid flow into discharge chamber 53 and causes pressure in the pump chamber 28 to accumulate upon stroking of the reciprocating element 18. When the reciprocating element 18 begins the forward or discharge stroke, the pressure builds inside the pump chamber 28 and acts as an opening force that results in positioning of the discharge valve assembly 72 in an open configuration, while a closing force (e.g., via a closing mechanism, such as a spring and/or pressure increase inside pump chamber 28) urges the suction valve assembly 56 into a closed configuration. When utilized in connection with a valve assembly, 'open' and 'closed' refer, respectively, to a configuration in which fluid can flow through the valve assembly (e.g., can pass between a valve body (e.g., a movable poppet) and a valve seat thereof) and a configuration in which fluid cannot flow through the valve assembly (e.g., cannot pass between a valve body (e.g., a movable poppet) and a valve seat thereof). As the reciprocating element 18 extends forward, fluid within the pump chamber 28 is discharged through the discharge outlet 54.

During a return or suction stroke, the reciprocating element 18 reciprocates or retracts away from the pump fluid end 22 and towards the pump power end 12 of the pump 10. Before the return stroke begins, the reciprocating element 18 is in a fully extended position (also referred to as top dead center (TDC) with reference to the crankshaft 16), in which case the discharge valve assembly 72 can be in a closed configuration having allowed fluid to flow out of the pump chamber 28 and the suction valve assembly 56 is in a closed configuration. When the reciprocating element 18 begins and retracts towards the pump power end 12, the discharge valve assembly 72 assumes a closed configuration, while the suction valve assembly 56 opens. As the reciprocating element 18 moves away from the discharge valve 72 during a return stroke, fluid flows through the suction valve assembly 56 and into the pump chamber 28.

With reference to the embodiment of FIG. 2A, which is a schematic showing a concentric pump fluid end 22 engaged with a reciprocating element 18, concentric bore pump fluid end 22 comprises a concentric bore fluid end body 8, a concentric pump chamber 28, a suction valve assembly 56, and a discharge valve assembly 72. In this concentric bore configuration of FIG. 2A, suction valve assembly 56 and discharge valve assembly 72 are positioned in-line (also referred to as coaxial) with reciprocating element bore 24, i.e., central axis 17 of reciprocating element bore 24 is also the central axis of suction pump assembly 56 and discharge valve assembly 72). With reference to the embodiment of FIG. 2B, which is a schematic showing a T-bore pump fluid end 22 engaged with a reciprocating element 18, T-bore pump fluid end 22 comprises a T-bore fluid end body 8, a T-shaped pump chamber 28, a suction valve assembly 56, and a discharge valve assembly 72. In this T-bore configuration of FIG. 2B, suction valve assembly 56 is coupled with front end 60 of reciprocating element 18 and discharge valve assembly 72 is positioned in bore 25 that makes a tee with reciprocating element bore 24, i.e., central axis 17 of reciprocating element bore 24 is also the central axis of suction pump assembly 56 and perpendicular to a central axis 27 of discharge valve assembly 72).

Suction valve assembly 56 and discharge valve assembly 72 are operable to direct fluid flow within the pump 10. In pump fluid end 22 designs of this disclosure, fluid flows within a hollow reciprocating element (e.g., a hollow plunger) 18 via fluid inlet 38 located toward tail end 62 of reciprocating element 18. The reciprocating element bore 24 of such a fluid end design can be defined by a high pressure cylinder or cylinder wall 26 providing a high pressure chamber. (As utilized here, "high pressure" indicates possible subjection to high pressure during discharge.) When reciprocating element 18 retracts, or moves along central axis 17 in a direction away from the pump chamber 28 and pump fluid end 22 and toward pump power end 12 (as indicated by arrow 116), a suction valve of the suction valve assembly 56 opens (e.g., either under natural flow and/or other biasing means), and a discharge valve of discharge valve assembly 72 will be closed, whereby fluid enters pump chamber 28 via a fluid inlet 38. For a pump fluid end 22 design of this disclosure, the fluid inlet 38 is configured to introduce fluid into pump chamber 28 via a reciprocating element 18 that is hollow. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge chamber 53 and discharge outlet 54.

A pump 10 of this disclosure can comprise one or more access ports. With reference to the concentric fluid end body 8 embodiment of FIG. 2A, a front access port 30A can be located on a front S1 of the pump fluid end 22 opposite a back S2 of the pump fluid end 22, wherein the back S2 of the pump fluid end is proximal the pump power end 12, upon integration therewith via integration section 11. With reference to the T-bore fluid end body 8 embodiment of FIG. 2B, a front access port 30A can be located on a front S1 of the pump fluid end 22 opposite a back S2 of the pump fluid end 22, wherein the back S2 of the pump fluid end is proximal the pump power end 12, upon integration therewith via integration section 11, and a top access port 30B can be located on a top S3 of the pump fluid end 22 opposite a bottom S4 of pump fluid end 22. Locations described as front S1, back S2, top S3, and bottom S4 are further described with reference to the x-y-z coordinate system shown in FIG. 1 and further can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to size and positioning of pump 10, the front S1 and top S3 of the pump fluid end 22 are more easily accessible than a back S2 or bottom S4 thereof. In a similar manner, a front of pump 10 is distal the pump power end 12 and a back of the pump 10 is distal the pump fluid end 22. The integration section 11 can be positioned in a space between the pump fluid end 22 and the pump power end 12, and can be safeguarded (e.g., from personnel) via a cover 15.

In embodiments, a pump fluid end 22 and pump 10 of this disclosure comprise at least one access port. In embodiments, the at least one access port is located on a side of the discharge valve assembly 72 opposite the suction valve assembly 56. For example, in the concentric bore pump fluid end 22 embodiment of FIG. 2A, front access port 30A is located on a side (e.g., front side) of discharge valve assembly 72 opposite suction valve assembly 56. In the T-bore pump fluid end 22 embodiment of FIG. 2B, front access port 30A is located on top S3 of pump fluid end 22.

In embodiments, one or more seals 29 (e.g., "o-ring" seals, packing seals, or the like), also referred to herein as 'primary' reciprocating element packing 29 (or simply "packing 29") may be arranged around the reciprocating element 18 to provide sealing between the outer walls of the reciprocating element 18 and the inner walls 26 defining at least a portion of the reciprocating element bore 24. The inner walls 26 can be provided by pump fluid end body 8 or a sleeve such as described hereinbelow. In fluid end designs such as described herein operated with a hollow reciprocating element 18, a second set of seals (also referred to herein as 'secondary' reciprocating element packing; not shown in the Figures) is conventionally arranged around the reciprocating element 18 to provide sealing between the outer walls of the reciprocating element 18 and the inner walls of a low-pressure cylinder that defines a low pressure fluid chamber (e.g., wherein the secondary packing is farther back along the x-axis and delineates a back end of a low pressure chamber that extends from the primary packing 29 to the secondary packing). In embodiments, only a primary reciprocating element packing is utilized, as fluid enters tail end 62 of reciprocating element 18 without first contacting an outer peripheral wall thereof (i.e., no secondary reciprocating element packing is needed/utilized, because no low pressure chamber external to reciprocating element 18 is utilized). Skilled artisans will recognize that the seals of the primary packing may comprise any suitable type of seals, and the selection of seals may depend on various factors e.g., fluid, temperature, pressure, etc.

While the foregoing discussion focused on a pump fluid end 22 comprising a single reciprocating element 18 disposed in a single reciprocating element bore 24, it is to be understood that the pump fluid end 22 may include any suitable number of reciprocating elements. As discussed further below, for example, the pump 10 may comprise a plurality of reciprocating elements 18 and associated reciprocating element bores 24 arranged in parallel and spaced apart along the z-axis of FIG. 1 (or another arrangement such as a V block or radial arrangement). In such a multi-bore pump, each reciprocating element bore may be associated with a respective reciprocating element and crank arm, and a single common crankshaft may drive each of the plurality of reciprocating elements and crank arms. Alternatively, a multi-bore pump may include multiple crankshafts, such that each crankshaft may drive a corresponding reciprocating element. Furthermore, the pump 10 may be implemented as any suitable type of multi-bore pump. In a non-limiting example, the pump 10 may comprise a Triplex pump having three reciprocating elements 18 (e.g., plungers or pistons) and associated reciprocating element bores 24, discharge valve assemblies 72 and suction valve assemblies 56, or a Quintuplex pump having five reciprocating elements 18 and five associated reciprocating element bores 24, discharge valve assemblies 72 and suction valve assemblies 56.

Reciprocating element bore 24 can have an inner diameter slightly greater than the outer diameter of the reciprocating element 18, such that the reciprocating element 18 may sufficiently reciprocate within reciprocating element bore 24 (optionally within a sleeve as described herein). In embodiments, the fluid end body 8 of pump fluid end 22 has a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 8 of pump fluid end 22 may be cast, forged or formed from any suitable materials, e.g., steel, metal alloys, or the like. Those versed in the art will recognize that the type and condition of material(s) suitable for the fluid end body 8 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 8 (e.g., cylinder wall 26 defining at least a portion of reciprocating element bore 24 and/or pump chamber 28) may include protective coatings for preventing and/or resisting abrasion, erosion, and/or corrosion.

In embodiments, the cylindrical shape (e.g., providing cylindrical wall(s) 26) of the fluid end body 8 may be pre-stressed in an initial compression. Moreover, a high-pressure cylinder(s) providing the cylindrical shape (e.g., providing cylindrical wall(s) 26) may comprise one or more sleeves (e.g., heat-shrinkable sleeves). Additionally or alternatively, the high-pressure cylinder(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or oversleeves may be added to increase fatigue strength and overall reinforcement of the components.

The cylinders and cylindrical-shaped components (e.g., providing cylindrical wall 26) associated with the pump fluid end body 8 of pump fluid end 22 may be held in place within the pump 10 using any appropriate technique. For example, components may be assembled and connected, e.g., bolted, welded, etc. Additionally or alternatively, cylinders may be press-fit (e.g., interference fit) into openings machined or cast into the pump fluid end 22 or other suitable portion of the pump 10. Such openings may be configured to accept and rigidly hold cylinders (e.g., having cylinder wall(s) 26 at least partially defining reciprocating element bore 24) in place so as to facilitate interaction of the reciprocating element 18 and other components associated with the pump 10.

In embodiments, the reciprocating element 18 comprises a plunger or a piston. While the reciprocating element 18 may be described herein with respect to embodiments comprising a plunger, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals (e.g., primary seal or packing 29) through which the plunger moves during each stroke (e.g., suction stroke or discharge stroke).

As skilled artisans will understand, the reciprocating element 18 may include any suitable size and/or shape for extending and retracting along a flow path within the pump fluid end 22. For instance, reciprocating element 18 may comprise a generally cylindrical shape, and may be sized such that the reciprocating element 18 can sufficiently slide against or otherwise interact with the inner cylinder wall 26. In embodiments, one or more additional components or mechanical linkages 4 (FIG. 4; e.g., clamps, adapters, extensions, etc.) may be used to couple the reciprocating element 18 to the pump power end 12 (e.g., to a crank arm 20 or pushrod 30).

According to this disclosure, reciprocating element 18 employed in a concentric bore pump fluid end 22 embodiment (such as depicted in FIG. 2A) or a T-bore pump fluid end 22 (such as depicted in FIG. 2B) comprises a peripheral wall 84 defining a hollow body. In embodiments, a portion of the peripheral wall 84 may be generally permeable or may include an input through which fluid may enter the hollow body and an output through which fluid may exit the hollow body. Furthermore, while the reciprocating element 18 may, in embodiments, define a substantially hollow interior and include a ported body, a base of the reciprocating element 18 proximal the pump power end 12, when assembled, may be substantially solid and/or impermeable (e.g., a plunger having both a hollow portion and a solid portion).

The reciprocating element 18 comprises a front or free end 60. According to this disclosure, suction valve assembly 56 is coupled with front end 60 of reciprocating element 18. In embodiments, the reciprocating element 18 can contain or at least partially contain the suction valve assembly 56. In one aspect, the suction valve assembly 56 is at least partially disposed within the reciprocating element 18 at or proximate to the front end 60 thereof. At an opposite or tail end 62 (also referred to as back end 62) of the reciprocating element 18, the reciprocating element 18 may include a base coupled to the pump power end 12 of the pump 10 (e.g., via crank arm 20). In embodiments, the tail end 62 of the reciprocating element 18 is coupled to the pump power end 12 outside of pump fluid end 22, e.g., within integration section 11.

As noted above, pump fluid end 22 contains a suction valve assembly 56. Suction valve assembly 56 may alternately open or close to permit or prevent fluid flow. Skilled artisans will understand that the suction valve assembly 56 may be of any suitable type or configuration (e.g., gravity- or spring-biased, flow activated, etc.). Those versed in the art will understand that the suction valve assembly 56 may be disposed within the pump fluid end 22 at any suitable location therein. For instance, the suction valve assembly 56 may be disposed within reciprocating element bore 24 and at least partially within reciprocating element 18 in concentric bore pump fluid end 22 designs such as FIG. 2A or T-bore pump fluid end 22 designs such as FIG. 2B, such that a suction valve body of the suction valve assembly 56 moves away from a suction valve seat within the a suction valve seat housing of reciprocating element 18 when the suction valve assembly 56 is opening and toward the suction valve seat when the suction valve assembly 56 is closing.

Pump 10 comprises a discharge valve assembly 72 for controlling the output of fluid through discharge chamber 53 and discharge outlet 54. Analogous to the suction valve assembly 56, the discharge valve assembly 72 may alternately open or close to permit or prevent fluid flow. Those versed in the art will understand that the discharge valve assembly 72 may be disposed within the pump chamber at any suitable location therein. For instance, the discharge valve assembly 72 may be disposed proximal the front S1 of bore 24 (e.g., at least partially within discharge chamber 53 and/or pump chamber 28) of the pump fluid end 22, such that a discharge valve body of the discharge valve assembly 72 moves toward the discharge chamber 53 when the discharge valve assembly 72 is in an open configuration and away from the discharge chamber 53 when the discharge valve assembly 72 is in a closed configuration. In addition, in concentric bore pump fluid end 22 configurations such as FIG. 2A, the discharge valve assembly 72 may be coaxially aligned with the suction valve assembly 56 (e.g., along central axis 17), and the suction valve assembly 56 and the discharge valve assembly 72 may be coaxially aligned with the reciprocating element 18 (e.g., along central axis 17). In alternative embodiments, such as the T-bore pump fluid end 22 embodiment of FIG. 2B, discharge valve assembly 72 can be positioned within T-bore 25, at least partially within discharge chamber 53 and/or pump chamber 28, and have a central axis coincident (e.g., coaxial) with central axis 27 of T-bore 25.

Further, the suction valve assembly 56 and the discharge valve assembly 72 can comprise any suitable mechanism for opening and closing valves. For example, the suction valve assembly 56 and the discharge valve assembly 72 can comprise a suction valve spring and a discharge valve spring, respectively. Additionally, any suitable structure (e.g., valve assembly comprising sealing rings, stems, poppets, valve guides, etc.) and/or components may be employed for retaining the components of the suction valve assembly 56 and the components of the discharge valve assembly 72 within the pump fluid end 22.

The pump 10 may comprise and/or be coupled (as detailed further hereinbelow) to any suitable fluid source for supplying fluid to the pump via the fluid inlet 38. In embodiments, the pump 10 may also comprise and/or be coupled to a pressure source such as a boost pump (e.g., a suction boost pump) fluidly connected to the pump 10 (e.g., via inlet 38) and operable to increase or "boost" the pressure of fluid introduced to pump 10 via fluid inlet 38. A boost pump may comprise any suitable type including, but not limited to, a centrifugal pump, a gear pump, a screw pump, a roller pump, a scroll pump, a piston/plunger pump, or any combination thereof. For instance, the pump 10 may comprise and/or be coupled to a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of pump 10 at about said pressures. Additionally or alternatively, the boost pump may have a flow rate of greater than or equal to about 80 BPM, about 70 BPM, and/or about 50 BPM.

As noted hereinabove, the pump 10 may be implemented as a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q10™ Quintuplex Pump or an HT-400™ Triplex Pump, produced by Halliburton Energy Services, Inc.

In embodiments, the pump fluid end 22 may comprise an external or stationary fluid manifold (e.g., a suction header) for feeding fluid to the multiple reciprocating assemblies via any suitable inlet(s). Additionally or alternatively, the pump fluid end 22 may comprise separate conduits such as hoses fluidly connected to separate inlets for inputting fluid to each reciprocating assembly. Of course, numerous other variations may be similarly employed, and therefore, fall within the scope of the present disclosure.

Those skilled in the art will understand that the reciprocating elements of each of the reciprocating assemblies may be operatively connected to the pump power end 12 of the pump 10 according to any suitable manner. For instance, separate connectors (e.g., cranks arms 20, connecting rods, etc.) associated with the pump power end 12 may be coupled to each reciprocating element body or tail end 62. The pump 10 may employ a common crankshaft (e.g., crankshaft 16) or separate crankshafts to drive the multiple reciprocating elements.

As previously discussed, the multiple reciprocating elements may receive a supply of fluid from any suitable fluid source, which may be configured to provide a constant fluid supply. Additionally or alternatively, the pressure of supplied fluid may be increased by adding pressure (e.g., boost pressure) as described previously. In embodiments, the fluid inlet(s) 38 receive a supply of pressurized fluid comprising a pressure ranging from about 30 psi to about 300 psi.

Additionally or alternatively, the one or more discharge outlet(s) 54 may be fluidly connected to a common collection point such as a sump or distribution manifold, which may be configured to collect fluids flowing out of the fluid outlet(s) 54, or another cylinder bank and/or one or more additional pumps.

During pumping, the multiple reciprocating elements 18 will perform forward and returns strokes similarly, as described hereinabove. In embodiments, the multiple reciprocating elements 18 can be angularly offset to ensure that no two reciprocating elements are located at the same position along their respective stroke paths (i.e., the plungers are "out of phase"). For example, the reciprocating elements may be angularly distributed to have a certain offset (e.g., 120 degrees of separation in a Triplex pump) to minimize undesirable effects that may result from multiple reciprocating elements of a single pump simultaneously producing pressure pulses. The position of a reciprocating element is generally based on the number of degrees a pump crankshaft (e.g., crankshaft 16) has rotated from a bottom dead center (BDC) position. The BDC position corresponds to the position of a fully retracted reciprocating element at zero velocity, e.g., just prior to a reciprocating element moving (i.e., in a direction indicated by arrow 117 in FIG. 2A and FIG. 2B) forward in its cylinder. A top dead center position corresponds to the position of a fully extended reciprocating element at zero velocity, e.g., just prior to a reciprocating element moving backward (i.e., in a direction indicated by arrow 116 in FIG. 2A and FIG. 2B) in its cylinder.

As described above, each reciprocating element 18 is operable to draw in fluid during a suction (backward or return) stroke and discharge fluid during a discharge (forward) stroke. Skilled artisans will understand that the multiple reciprocating elements 18 may be angularly offset or phase-shifted to improve fluid intake for each reciprocating element 18. For instance, a phase degree offset (at 360 degrees divided by the number of reciprocating elements) may be employed to ensure the multiple reciprocating elements 18 receive fluid and/or a certain quantity of fluid at all times of operation. In one implementation, the three reciprocating elements 18 of a Triplex pump may be phase-shifted by a 120-degree offset. Accordingly, when one reciprocating element 18 is at its maximum forward stroke position, a second reciprocating element 18 will be 60 degrees through its discharge stroke from BDC, and a third reciprocating element will be 120 degrees through its suction stroke from top dead center (TDC).

Figure 4A:
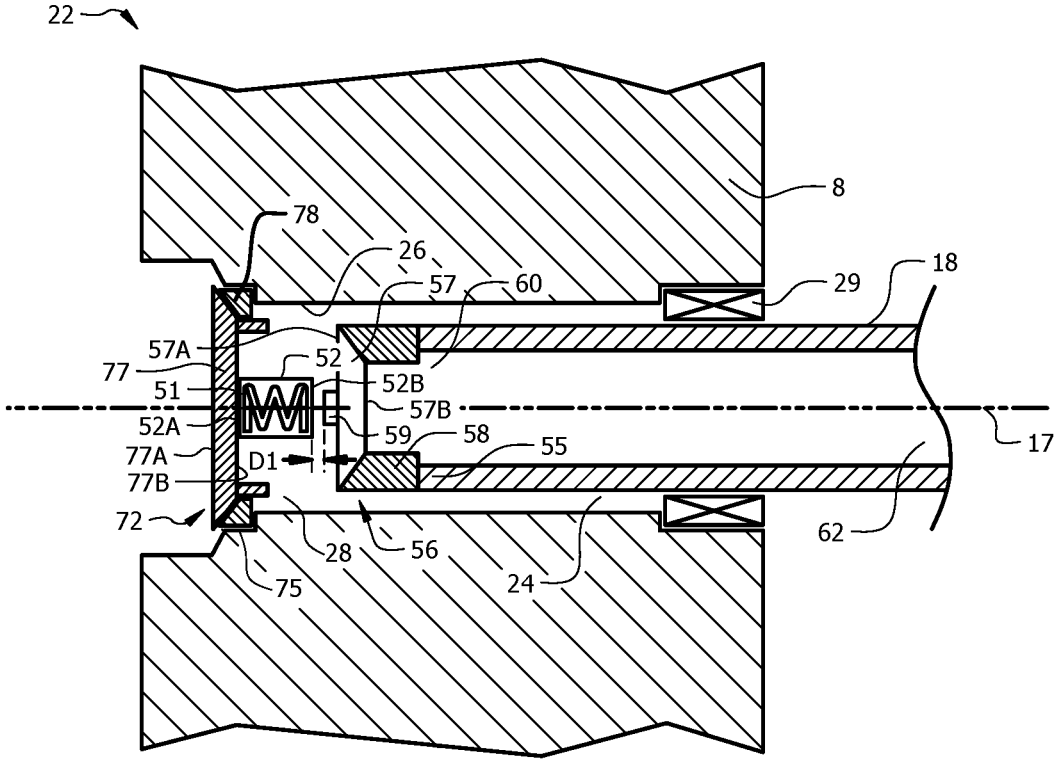
FIG. 4A is a schematic of a concentric bore pump fluid end comprising a suction valve stop, according to embodiments of this disclosure.
Figure 4B:
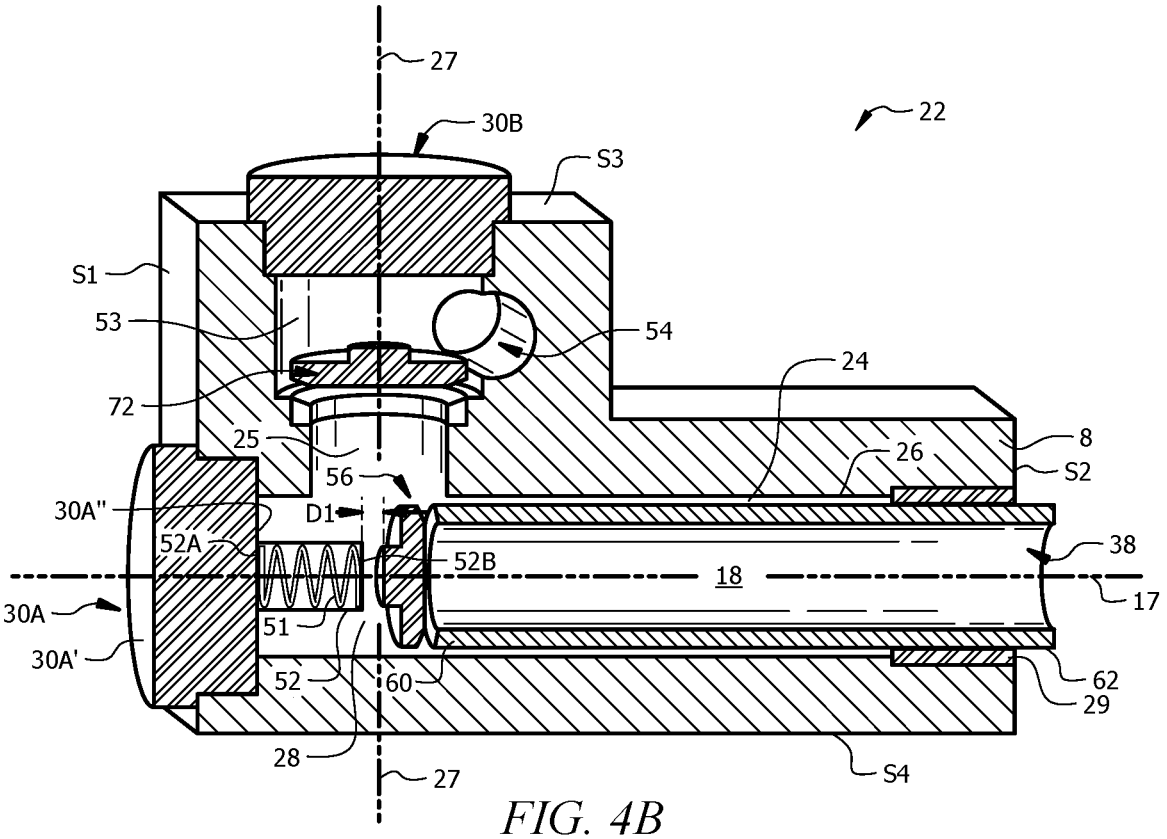
FIG. 4B is a schematic of a cross-bore pump fluid end (e.g., a tee-bore ("T-bore")) pump fluid end comprising a suction valve stop, according to embodiments of this disclosure.

According to this disclosure, a pump fluid end 22 (e.g., a concentric bore pump fluid end 22 such as depicted in FIG. 2A (and FIG. 4A described hereinbelow) or a cross-bore pump fluid end such as T-bore pump fluid end 22 of FIG. 2B (and FIG. 4B described hereinbelow)) comprises a reciprocating element 18 disposed at least partially within a reciprocating element bore 24 of the pump fluid end 22, a discharge valve assembly 72, a suction valve assembly 56, and a suction valve stop 52. FIG. 4A is a schematic of a concentric bore pump fluid end 22 comprising a suction valve stop 52, according to embodiments of this disclosure; FIG. 4B is a schematic of a cross-bore pump fluid end 22 (e.g., a tee-bore pump fluid end 22) comprising a suction valve stop 52, according to embodiments of this disclosure. According to this disclosure, suction valve assembly 56 is coupled with front end 60 of reciprocating element 18. A pump fluid end 22 of this disclosure comprises a suction valve stop 52. Suction valve stop 52 is positioned within the reciprocating element bore 24 such that (a back side 52B of) the suction valve stop 52 contacts and applies a closing force to the suction valve assembly 56 when the suction valve assembly 56 is stuck open at the end of a discharge stroke of the reciprocating element 18. Front side 52A of suction valve stop 52 is opposite back side 52B of suction valve stop 52. Front side 52A of suction valve stop 52 is a side of suction valve stop 52 proximate front S1 (FIG. 1, FIG. 2A and FIG. 2B) of pump fluid end 22, while back side 52B of suction valve stop 52 is a side of suction valve stop 52 distal front S1 of pump fluid end 22.

Suction valve assembly 56 can comprise a suction valve body 57 and a suction valve seat 58. Suction valve seat 58 can be disposed in a suction valve seat housing 55. According to this disclosure, suction valve seat housing 55 can be a portion of reciprocating element 18 or can be a component (e.g., a suction valve seat adapter) fixedly coupled with reciprocating element 18. In an open configuration of suction valve assembly 56, suction valve body 57 and suction valve seat 58 are separated by an opening distance, such that fluid can flow through suction valve assembly 56. Similarly, discharge valve assembly 72 can comprise a discharge valve body 77 and a discharge valve seat 78. Discharge valve seat 78 can be disposed in a discharge valve seat housing 75. In an open configuration of discharge valve assembly 72, discharge valve body 77 and discharge valve seat 78 are not in contact (e.g., are separated by an opening distance), such that fluid can flow through discharge valve assembly 72. Suction valve body 57 and discharge valve body 77 can be any known valve bodies, for example, movable valve poppets, and can be wing guided and/or stem guided, or a combination thereof.

In embodiments of this disclosure, reciprocating element 18 comprises a hollow portion (i.e., is at least partially hollow). In embodiments, reciprocating element 18 comprises tool engagement features on front 60 thereof, whereby reciprocating element 18 can be removed from pump fluid end 22 by engaging a tool with the tool engagement features, as described, for example, in U.S. patent application Ser. No. 16/411,905 filed May 14, 2019, which is entitled "Pump Plunger with Wrench Features", the disclosure of which is hereby incorporated herein in its entirety for purposes not contrary to this disclosure.

In embodiments, discharge valve assembly 72 and/or suction valve assembly 56 comprises a valve assembly having a valve guide, as described, for example, in U.S. patent application Ser. No. 16/411,910 filed May 14, 2019, which is entitled "Valve Assembly for a Fluid End with Limited Access", the disclosure of which is hereby incorporated herein in its entirety for purposes not contrary to this disclosure. In embodiments, a discharge valve seat 78 of discharge valve assembly 72 and/or a suction valve seat 58 of suction valve assembly 56 is a valve seat with supplemental retention, as described, for example, in U.S. patent application Ser. No. 16/411,898 filed May 14, 2019, which is entitled "Pump Valve Seat with Supplemental Retention", the disclosure of which is hereby incorporated herein in its entirety for purposes not contrary to this disclosure. In embodiments, pump fluid end 22 is a pump fluid end 22 with an easy access suction valve, as described, for example, in U.S. patent application Ser. No. 16/411,891 filed May 14, 2019, which is entitled "Pump Fluid End with Easy Access Suction Valve", the disclosure of which is hereby incorporated herein in its entirety for purposes not contrary to this disclosure.

In embodiments, suction valve assembly 56 provides an opening distance (e.g., a distance between suction valve seat 58 and suction valve body 57 when the suction valve assembly 56 is in an open configuration) that is in a range of from about 0 to about 1 inch (from about 0 to about 2.54 cm), from about 0.1 inch to about 0.5 inch (from about 0.25 to about 1.27 cm), from about 0.1 inch to about 0.4 inch (from about 0.25 to about 1.02 cm), from about 0.12 inch to about 0.38 inch (from about 0.30 to about 0.97 cm) or less than or equal to about 1, 0.5, 0.4, 0.3, 0.2, or 0.1 inch (less than or equal to about 2.54, 1.27, 1.02, 0.76, 0.51, or 0.25 cm). In embodiments, a wellbore servicing fluid pumped via a pump of this disclosure comprising suction valve stop 52 comprises particles (e.g., particulate material) that have an average dimension that is at least about 75, 80, 85, 90, 95, 100% or greater than 100% of the opening distance between the suction valve seat 58 and the suction valve body 57 of the suction valve assembly 56 when the suction valve assembly 56 is open (e.g., is in the open configuration.

As mentioned hereinabove, during operation, particulate material can get lodged between suction valve seat 58 and suction valve body 57 of suction valve assembly 56. When the suction valve assembly 56 is stuck in an open position at the end of a discharge stroke of reciprocating element 18 (e.g., when a crankshaft 16 of pump power end 12 is at top dead center (TDC)), (e.g., a nearest component of) suction valve assembly 56 contacts back side 52B of suction valve stop 52, thus applying a closing force to the suction valve assembly 56. The nearest component of suction valve assembly 56 can comprise a front side 57A of a suction valve body 57 of suction valve assembly 56 and/or a component thereof or integrated therewith. For example, the nearest component can be front side 57A of suction valve body 57 or a coupler actuating feature 59 of suction valve body 57 or coupled with suction valve body 57. Coupler actuating feature 59 can be operable to couple suction valve body 57 or discharge valve body 77 with a valve guide, as described in U.S. patent application Ser. No. 16/411,910 filed May 14, 2019, which is entitled "Valve Assembly for a Fluid End with Limited Access". Front side 57A of suction valve body 57 is opposite back side 57B of suction valve body 57. Front side 57A of suction valve body 57 is a side of suction valve body 57 proximate front S1 (FIG. 1, FIG. 2A and FIG. 2B) of pump fluid end 22, while back side 57B of suction valve body 57 is a side of suction valve body 57 distal front S1 of pump fluid end 22. Desirably, the closing force provided by the contact of suction valve stop 52 with suction valve assembly 56 is sufficient to mechanically close the suction valve assembly 56 (e.g., to position suction valve body 57 in contact with suction valve seat 58), thus essentially resetting the suction valve assembly 56. For example, suction valve stop 52 can be designed and positioned such that the closing force provided when suction valve stop 52 contacts suction valve assembly 56 is greater than a crush strength of a particulate material in a wellbore servicing fluid pumped by the pump 10 comprising the suction valve stop 52. In such a manner, any particulate material disposed between suction valve body 57 and suction valve seat 58 at the end of a discharge stroke of reciprocating element 18 will be mechanically crushed by the closing force provided when suction valve stop 52 contacts suction valve assembly 56, thereby enabling suction valve assembly 56 to close and pump 10 to maintain normal operation. As utilized herein, 'mechanically closing' indicates the application of force via mechanical/structural contact of components to push suction valve body 57 into contact with suction valve seat 58.

In embodiments, suction valve stop 52 is positioned such that, when suction valve assembly 56 is not stuck in an open position at the end of the discharge stroke of reciprocating element 18, a minimum distance D1 between the suction valve assembly 56 and the suction valve stop 52 is greater than zero, such that the suction valve assembly 56 does not contact the suction valve stop 52 during normal operation of a pump 10 comprising the pump fluid end 22. In alternative embodiments, when the suction valve assembly 56 is not stuck in an open position at the end of the discharge stroke of reciprocating element 18, a minimum distance D1 between the suction valve assembly 56 and the suction valve stop 52 is zero, such that the suction valve assembly 56 contacts the suction valve stop 52 during normal operation of the pump. As utilized herein, "normal" operation indicates operation when suction valve assembly 56 is not stuck open at the end of a discharge stroke of reciprocating element 18.

Suction valve stop 52 is positioned such that, when suction valve stop 52 contacts suction valve assembly 56 (e.g., during normal operation and/or when suction valve assembly 56 is stuck open at the end of the discharge stroke of reciprocating element 18), the contact provides a closing force (e.g., to close suction valve assembly 56 by pushing suction valve body 57 into contact with suction valve seat 58). In embodiments, the closing force is less than a rod load limit of a connecting rod (e.g., of mechanical linkages 4 described hereinabove with reference to FIG. 3) coupled to the tail end 62 of reciprocating element 18 and the pump power end 12 of the pump 10. In embodiments, when the suction valve stop 52 contacts the suction valve assembly 56 when the suction valve assembly 56 is stuck open at the end of the discharge stroke of the reciprocating element 18, the suction valve stop 52 provides a closing force to the suction valve assembly 56 that is greater than a crush strength of a particulate material stuck between the suction valve body 57 and the suction valve seat 58, keeping the suction valve assembly 56 stuck in the open configuration, thus crushing the stuck particulate material and resetting the suction valve assembly 56 for the next reciprocating element cycle. In embodiments, when the suction valve stop 52 contacts the suction valve assembly 56 when the suction valve assembly 56 is stuck open at the end of the discharge stroke of the reciprocating element 18, the suction valve stop 52 provides a maximum closing force to the suction valve assembly 56 that is less than the rod load limit of the connecting rod (e.g., or other mechanical linkage 4) coupled to the reciprocating element 18 and the pump power end 12 of the pump 10 comprising the pump fluid end 22 and the pump power end 12. In embodiments, the rod load limit is greater than or equal to about 200,000, 250,000, or 300,000 $lb_f$.

In embodiments, such as depicted in FIG. 2A and FIG. 4A, the pump fluid end 22 comprising suction valve stop 52 according to this disclosure is a concentric bore pump fluid end 22. In such concentric bore pump fluid end 22 embodiments, the discharge valve assembly 72 and the suction valve assembly 56 are coaxially aligned (e.g., along central axis 17) within the pump fluid end 22. In such embodiments, suction valve stop 52 can be coupled to the discharge valve assembly 72. For example, as depicted in the embodiment of FIG. 4A, suction valve stop 52 can be coupled to the discharge valve body 77 on a side thereof (e.g., a back side 77B thereof) proximate the reciprocating element 18. Back side 77B of discharge valve body 77 is opposite front side 77A of discharge valve body 77. Front side 77A of discharge valve body 77 is a side of discharge valve body 77 proximate front S1 (FIG. 1, FIG. 2A and FIG. 2B) of pump fluid end 22, while back side 77B of discharge valve body 77 is a side of discharge valve body 77 distal front S1 of pump fluid end 22.

In embodiments, such as depicted in FIG. 2B and FIG. 4B, the pump fluid end 22 comprising suction valve stop 52 according to this disclosure is a cross-bore pump fluid end 22. In the embodiment of FIG. 2B and FIG. 4B, pump fluid end 22 is a tee-bore pump fluid end 22. In such embodiments, the suction valve stop 52 can be coupled to a component of pump fluid end 22 other than discharge valve assembly 72. For example, in some such cross-bore pump fluid end 22 embodiments, the suction valve stop 52 can be coupled with a fluid end body 8 of the pump fluid end. In embodiments, as depicted in the embodiment of FIG. 4B, the suction valve stop 52 can be coupled to an access port, such as front access port 30A, of pump fluid end 22. In such latter embodiments, the suction valve stop 52 can be coupled to a back side 30A" of front access port 30A. Back side 30A" of front access port 30A is opposite front side 30A' of front access port 30A. Front side 30A' of front access port 30A is a side of front access port 30A proximate front S1 (FIG. 1, FIG. 2A and FIG. 2B) of pump fluid end 22, while back side 30A" of front access port 30A is a side of front access port 30A distal front S1 of pump fluid end 22.

Suction valve stop 52 can comprise any component operable to provide a closing force to suction valve assembly 56 sufficient to mechanically force suction valve body 57 into contact with suction valve seat 58 when suction valve stop 52 contacts suction valve assembly 56. For example and without limitation, in embodiments such as depicted in FIG. 4A and FIG. 4B, suction valve stop 52 comprises a spring 51, which may be contained within a spring housing (e.g., a cylindrical body that protects spring 51 and prevents spring 51 from undesired deformation in a direction perpendicular to central axis 17) and may further comprise a contact surface (e.g., a button) for contacting suction valve assembly 56 and positioned on an end of spring 51 opposite an end of spring 51 contacting back side 77B of discharge valve body 77 or back side 30A" of front access port 30A. Alternatively or additionally, suction valve stop 52 can comprise a cushioned stop, a hard stop, a spring-loaded stop, or a combination thereof. For example, in embodiments, spring 51 is surrounded by a cushioned outer cylindrical bumper and a hard inner bumper is positioned inside spring 51. In embodiments, suction valve stop 52 comprises a cushioned stop, such as, without limitation, a urethane bumper. In embodiments, suction valve stop 52 is a hard stop designed to shear at certain loading, such as, without limit, the rod load limit of the pump 10 or 80, 85, 90, or 95% of the rod load limit.

A front side 52A of suction valve stop 52 can be coupled with a component of pump fluid end 22 (e.g., back side 77B of discharge valve body 77 of discharge valve assembly 72 in the embodiment of FIG. 4A or back side 30A" of front access port 30A in the embodiment of FIG. 4B) in any suitable manner that retains suction valve stop 52 stationary within reciprocating element bore 24 of pump fluid end 22. For example, suction valve stop 52 can be coupled with the component of pump fluid end 22 by welding, threaded connection, mechanical fastener (bolt and nut), pinning. Alternatively or additionally, in embodiments, suction valve stop 52 can be cast, forged, or otherwise an integral component of discharge valve assembly 72 (e.g., of discharge valve body 77). Thus, in embodiments, suction valve stop 52 can be threaded, bolted, pinned, and/or welded to the component of the pump fluid end 22, or can be forged or cast as an integral part of the component (e.g., of the discharge valve assembly 72 (e.g., a discharge valve body 77 thereof)).

Back side 52B of suction valve stop 52 contacts suction valve assembly 56 (at least) when suction valve assembly 56 is stuck in the open configuration at the end of a discharge stroke of reciprocating element 18.

In embodiments, suction valve assembly 56 and/or discharge valve assembly 72 of pump fluid end 22 comprises a valve poppet assembly, as described, for example, in U.S. patent application Ser. No. 16/436,356 filed Jun. 10, 2019, which is entitled "Multi-Material Frac Valve Poppet", the disclosure of which is hereby incorporated herein in its entirety for purposes not contrary to this disclosure.

In embodiments, pump fluid end 22 comprises a packing assembly, such that packing 29, a packing carrier, and a packing screw can be removed from back S2 of pump fluid end 22 when crankshaft 16 is at TDC, as described, for example, in U.S. patent application Ser. No. 16/411,911 filed May 14, 2019, entitled "Pump Fluid End with Positional Indifference for Maintenance", the disclosure of which is hereby incorporated herein in its entirety for purposes not contrary to this disclosure.

In embodiments, pump 10 comprises a flexible manifold for feeding fluid into reciprocating element 18, as described, for example, in U.S. patent application Ser. No. 16/411,901 filed May 14, 2019, which is entitled "Flexible Manifold for Reciprocating Pump", the disclosure of which is hereby incorporated herein in its entirety for purposes not contrary to this disclosure.

Also disclosed herein is a pump 10 comprising a pump fluid end 22 of this disclosure comprising a suction valve stop 52 as described herein, and a pump power end 12. As described hereinabove, the pump power end 12 is operable to reciprocate the reciprocating element 18 within the reciprocating element bore 24 of the pump fluid end 22. As described hereinabove with reference to the embodiment of FIG. 2A and FIG. 4A, in embodiments the pump fluid end 22 of a pump 10 of this disclosure is a concentric bore pump fluid end 22. In such embodiments, the discharge valve assembly 72 can be coaxial with suction valve assembly 56, and the suction valve stop 52 can be positioned on back side 77B of discharge valve body 77 of discharge valve assembly 72. In alternative embodiments, the pump fluid end 22 of a pump 10 of this disclosure is a cross-bore pump fluid end 22. For example and without limitation, in embodiments such as described hereinabove with reference to the embodiments of FIG. 2B and FIG. 4B, the pump fluid end 22 is a cross-bore pump fluid end 22 comprising a tee-bore 25 perpendicular to the reciprocating element bore 24. In such embodiments, the discharge valve assembly 72 can be located in the tee-bore 25, (e.g., proximate the top 53 of the fluid end 22 and the top access port 30B) and the suction valve stop 52 can be positioned in the fluid chamber 28 of the pump fluid end 22 and can be attached (e.g., bolted and/or welded), for example, to back 30A" of front access port cover 30A.

As noted above, the pump power end 12 has a rod load limit, and the suction valve stop 52 is positioned such that, when the suction valve stop 52 contacts the suction valve assembly 56 (e.g., contacts at least a portion of front 57A of suction valve body 57 or a component (e.g., a coupler actuating feature 59) attached thereto and/or integrated therewith that is closest to suction valve stop 52) when the suction valve assembly 56 is stuck open at the end of the discharge stroke of the reciprocating element 18, the suction valve stop 52 provides a maximum closing force to the suction valve assembly 56 that is less than the rod load limit of a connecting rod (e.g., of mechanical linkages 4) coupled to the reciprocating element 18 and the pump power end 12.

In embodiments, reciprocating element 18 is coupled with a pushrod 30 of pump power end 12 via a reciprocating element adapter, as described, for example, in U.S. patent application Ser. No. 16/411,894 filed May 14, 2019, which is entitled "Easy Change Pump Plunger", the disclosure of which is hereby incorporated herein in its entirety for purposes not contrary to this disclosure. As described therein, in such embodiments, mechanical linkages 4 can comprise the reciprocating element adapter and/or a clamp.

A pump 10 of this disclosure can comprise multi-layer surface coating disposed on reciprocating element 18 and/or a sleeve that provides cylindrical wall 26, as described, for example, in U.S. patent application Ser. No. 16/436,389 filed Mar. 9, 2021, which is entitled "Multi-Layer Coating for plunger and/or Packing Sleeve", the disclosure of which is hereby incorporated herein in its entirety for purposes not contrary to this disclosure.

A pump 10 of this disclosure can be a multiplex pump comprising a plurality of reciprocating elements 18, and a corresponding plurality of reciprocating element bores 24, suction valve assemblies 56, discharge valve assemblies 72, and suction valve stops 52 (which can be any type of suction valve stop 52 described herein). The plurality can comprise any number such as, for example, 2, 3, 4, 5, 6, 7, or more. For example, in embodiments, pump 10 is a triplex pump, wherein the plurality comprises three. In alternative embodiments, pump 10 comprises a Quintuplex pump, wherein the plurality comprises five.

Also disclosed herein is a method of preventing a suction valve assembly 56 of a pump 10 from being stuck open at an end of a discharge stroke of reciprocating element 18 within reciprocating element bore 24 of pump 10 when pump 10 is pumping a wellbore servicing fluid comprising particulates. The method comprises: providing a suction valve stop 52, as described herein, wherein the suction valve stop 52 is positioned within the reciprocating element bore 24 of the pump 10 such that, when the suction valve assembly 56 is stuck open (e.g., suction valve body 57 is not in contact or complete contact with suction valve seat 58) at the end of a discharge stroke of the reciprocating element 18, the suction valve stop 52 contacts the suction valve assembly 56 with a closing force to mechanically close the suction valve assembly 56 (e.g., to force suction valve body 57 to contact or fully contact suction valve seat 58). In embodiments, a back side 52B of suction valve stop 52 contacts a component of suction valve assembly 56 axially closest thereto (e.g., along central axis 17). For example, in embodiments, back side 52B of suction valve stop 52 contacts a front side 57A of suction valve body 57. In embodiments, back side 52B of suction valve stop 52 contacts a component coupled with front side 57A of suction valve body 57 and axially closest to suction valve stop 52. Such a component can comprise, for example, a coupler actuating feature 59, as described hereinabove. In embodiments, the closing force provided by the contacting of the suction valve stop 52 with suction valve assembly 56 is greater than a crush strength of the particulates in the wellbore servicing fluid and less than a rod load limit of a connecting rod (e.g., of mechanical linkages 4) coupled to the reciprocating element 18 and pump power end 12. In embodiments, the closing force provided is in a range of from about 0 to about 200,000 $lb_f$, from about 0 to about 250,000 $lb_f$, or from about 0 to about 300,000 $lb_f$.

Figure 5:
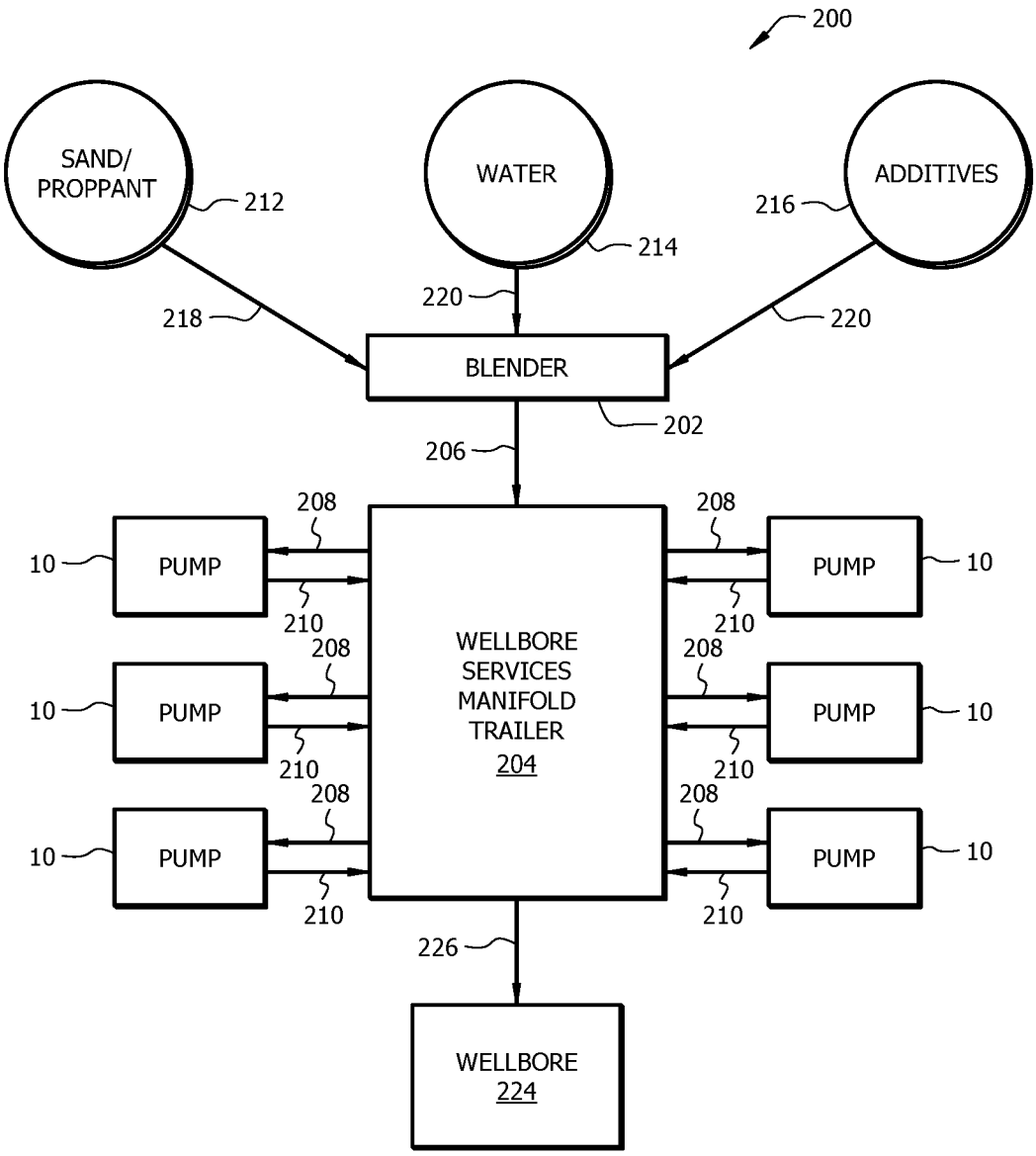
FIG. 5 is a schematic representation of an embodiment of a wellbore servicing system, according to embodiments of this disclosure.

Also disclosed herein are a method of servicing a wellbore and a wellbore servicing system 200 comprising a pump of this disclosure. An embodiment of a wellbore servicing system 200 and a method of servicing a wellbore via the wellbore servicing system 200 will now be described with reference to FIG. 5, which is a schematic representation of an embodiment of a wellbore servicing system 200, according to embodiments of this disclosure.

A method of servicing a wellbore 224 according to this disclosure comprises: fluidly coupling a pump 10 of this disclosure to a source of a wellbore servicing fluid and to the wellbore; and communicating wellbore servicing fluid into the wellbore via the pump 10. As described hereinabove, a pump 10 of this disclosure comprises a pump fluid end 22 and a pump power end 12. The pump power end 12 can be a pump power end 12 as described herein, and is operable to reciprocate the reciprocating element 18 within the reciprocating element bore 24 of the pump fluid end 22. The pump fluid end 22 comprises: a reciprocating element 18, a discharge valve assembly 72, a suction valve assembly 56, and a suction valve stop 52 as detailed hereinabove. The reciprocating element 18 is disposed at least partially within reciprocating element bore 24 of the pump fluid end 22. The suction valve assembly 56 is coupled with (e.g., disposed at least partially within) a front end 60 of the reciprocating element 18. The suction valve stop 52 is positioned within the reciprocating element bore 24 such that a back 52B of the suction valve stop 52 contacts the suction valve assembly 56 (e.g., a component of suction valve assembly 56 closest to back side 52B of suction valve stop 52 (at least) when the suction valve assembly 56 is stuck open at the end of a discharge stroke of the reciprocating element 18.

During normal operation of pump 10 during pumping, on a suction stroke of the pump 10, wellbore servicing fluid is drawn into pump chamber 28 of the pump 10 via a hollow portion of reciprocating element 18 of the pump, and a suction valve assembly 56 of the pump 10 is in an open configuration (e.g., suction valve body 57 of suction valve assembly 56 is not in contact with suction valve seat 58) and a discharge valve assembly 72 of the pump 10 is in a closed configuration (e.g., discharge valve body 77 of discharge valve assembly 72 is in contact with discharge valve seat 78. During normal operation of pump 10, on a discharge stroke of the pump 10, wellbore servicing fluid is discharged from the pump chamber 28 into high pressure discharge chamber 53 fluidly connected with the wellbore 224, and the suction valve assembly 56 is in a closed configuration (e.g., suction valve body 57 of suction valve assembly 56 is in contact with suction valve seat 58) and the discharge valve assembly 72 is in an open position (e.g., discharge valve body 77 of discharge valve assembly 72 is not in contact with discharge valve seat 78). If the suction valve assembly 56 is stuck in an open configuration at the end of a discharge stroke of reciprocating element 18 (e.g., due to the presence of a particulate material in an opening between suction valve body 57 and suction valve seta 58), the suction valve assembly 56 (e.g., a component thereof, such as front side 57A of suction valve body 57 or a component (e.g., a coupler actuating feature 59) thereof and/or attached thereto that is closest to suction valve stop 52) contacts suction valve stop 52 with a closing force that mechanically closes the suction valve assembly 56. As noted hereinabove, 'mechanically closing' indicates the application of force to push suction valve body 57 into contact with suction valve seat 58 of suction valve assembly 56.

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, diverter fluids, sealants, drilling fluids, completion fluids, gelation fluids, polymeric fluids, aqueous fluids, oleaginous fluids, etc. For example, in embodiments, the wellbore servicing fluid is a diverter fluid comprising a diverting agent, such as, for example and without limitation, BIOVERT® NWB, available from Halliburton Energy Services.

In embodiments, the wellbore servicing system 200 comprises one or more pumps 10 operable to perform oilfield and/or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 10 disclosed herein may be employed in any suitable operation.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 10 that may be mounted to a trailer and transported to the wellsite via a semi-tractor) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 10. Inlet flowlines 210 are inlet lines from the pumps 10 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines 218, 220, and 212, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 10 (e.g., pump(s) 10 and/or maintained pump(s) 10) pressurize the wellbore servicing fluid to a pressure suitable for delivery into a wellbore 224 or wellhead. For example, the pumps 10 may increase the pressure of the wellbore servicing fluid (e.g., the wellbore servicing fluid and/or the another wellbore servicing fluid) to a pressure of greater than or equal to about 3,000 psi, 5,000 psi, 10,000 psi, 20,000 psi, 30,000 psi, 40,000 psi, or 50,000 psi, or higher.

From the pumps 10, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. In embodiments, each of one or more pumps 10 discharge wellbore servicing fluid at a fluid flow rate of between about 1 BPM to about 200 BPM, alternatively from between about 50 BPM to about 150 BPM, alternatively about 100 BPM. In embodiments, each of one or more pumps 10 discharge wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore 224 (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In other embodiments, the wellbore servicing systems and methods may be employed in well completion operations such as primary and secondary cementing operation to isolate the subterranean formation from a different portion of the wellbore.

In embodiments, a wellbore servicing method may comprise transporting a positive displacement pump (e.g., pump 10) to a site for performing a servicing operation. Additionally or alternatively, one or more pumps may be situated on a suitable structural support. Non-limiting examples of a suitable structural support or supports include a trailer, truck, skid, barge or combinations thereof. In embodiments, a motor or other power source for a pump may be situated on a common structural support.

In embodiments, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared onsite (e.g., via the operation of one or more blenders) or, alternatively, transported to the site of the servicing operation.

In embodiments, a wellbore servicing method may comprise fluidly coupling a pump 10 to the wellbore servicing fluid source. As such, wellbore servicing fluid may be drawn into and emitted from the pump 10. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In alternative embodiments, the reciprocating apparatus may comprise a compressor. In embodiments, a compressor similar to the pump 10 may comprise at least one each of a cylinder, plunger, connecting rod, crankshaft, and housing, and may be coupled to a motor. In embodiments, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber.

Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In embodiments, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element 18 such as a plunger may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Those of ordinary skill in the art will readily appreciate various benefits that may be realized by the present disclosure. For instance, in embodiments, the herein disclosed pump fluid end 22 design comprising a suction valve stop 52 as described herein can provide for an increased amount of normal operation time (e.g., time when suction valve assembly 56 is not stuck open at the end of a discharge stroke of reciprocating element 18) for a pump 10 of this disclosure. Via utilization of a pump fluid end 22 of this disclosure comprising a suction valve stop 52, fluids (e.g., wellbore servicing fluids) comprising particulates can be pumped without specially equipped pumps conventionally utilized for such applications, thus potentially reducing capital expense. In this manner, fluids that haven't been screened (e.g., sized) properly and/or that include random large particulates that conventionally cause premature wear and/or washout of suction valve body 57 and suction valve seat 58 can be successfully pumped. The suction valve stop 52 of this disclosure is contained entirely within pump fluid end 22, does not utilize or require an external control system, and provides a maximum closing force to the suction valve assembly 56 that can be substantial (e.g., with the only requirement that said closing force being less than the rod load limit of the pump power end 12, as described herein).

In embodiments, the herein disclosed design enables the use of a fluid end 22 which does not have a cross-bore that houses the suction valve body 57 of suction valve assembly 56 and/or the discharge valve body 77 of discharge valve assembly 72. According to this disclosure, the suction valve body 57 of suction valve assembly 56 can be mounted on the moving reciprocating element 18. In embodiments, the suction valve assembly 56 and the discharge valve assembly 72 can be arranged in a concentric manner in line (e.g., coaxially along central axis 17) within reciprocating element bore 24 and/or a sleeve positioned therein.

ADDITIONAL DISCLOSURE

The following are non-limiting, specific embodiments in accordance with the present disclosure:

Embodiment A: A pump fluid end comprising: a reciprocating element disposed at least partially within a reciprocating element bore of the pump fluid end; a discharge valve assembly; a suction valve assembly coupled with a front end of the reciprocating element; and a suction valve stop, wherein the suction valve stop is positioned within the reciprocating element bore such that the suction valve stop contacts and applies a closing force to the suction valve assembly when the suction valve assembly is stuck open at the end of a discharge stroke of the reciprocating element.

Embodiment B: The pump fluid end of Embodiment A, wherein the pump fluid end is a concentric bore pump fluid end, wherein the discharge valve assembly and the suction valve assembly are coaxially aligned within the pump fluid end, and wherein the suction valve stop is coupled to the discharge valve assembly.

Embodiment C: The pump fluid end of Embodiment B, wherein the discharge valve assembly comprises a discharge valve seat and a discharge valve body, and wherein the suction valve stop is coupled to the discharge valve body on a side thereof proximate the reciprocating element.

Embodiment D: The pump fluid end of Embodiment A, wherein the pump fluid end is a tee-bore pump fluid end, and wherein the suction valve stop is coupled with a fluid end body of the pump fluid end.

Embodiment E: The pump fluid end of any of Embodiment A through Embodiment D, wherein the suction valve stop comprises a spring, a cushioned stop, a hard stop, or a combination thereof Embodiment F: The pump fluid end of any of Embodiment A through Embodiment E, wherein the suction valve stop comprises a urethane bumper.

Embodiment G: The pump fluid end of any of Embodiment A through Embodiment F, wherein, when the suction valve stop contacts the suction valve assembly when the suction valve assembly is stuck open at the end of the discharge stroke of the reciprocating element, the suction valve stop provides a maximum closing force to the suction valve assembly that is less than a rod load limit of a connecting rod coupled to the reciprocating element and a pump power end of a pump comprising the pump fluid end and the pump power end.

Embodiment H: The pump fluid end of Embodiment G, wherein the rod load limit is greater than or equal to about 200,000, 250,000, or 300,000 $lb_f$.

Embodiment I: A pump comprising: the pump fluid end of any of Embodiment A through Embodiment H; and a pump power end, wherein the pump power end is operable to reciprocate the reciprocating element within the reciprocating element bore of the pump fluid end.

Embodiment J: The pump of Embodiment I, wherein the pump fluid end is a concentric bore pump fluid end.

Embodiment K: The pump of Embodiment I, wherein the pump fluid end is a cross-bore pump fluid end.

Embodiment L: The pump of Embodiment K, wherein the pump fluid end is a cross-bore pump fluid end comprising a tee-bore perpendicular to the reciprocating element bore, wherein the discharge valve assembly is located in the tee-bore, and wherein the suction valve stop is coupled and/or integral with a front access cover of the pump fluid end.

Embodiment M: The pump of any of Embodiment I through Embodiment L, wherein the pump power end has a rod load limit, and wherein, when the suction valve stop contacts the suction valve assembly when the suction valve assembly is stuck open at the end of the discharge stroke of the reciprocating element, the suction valve stop provides a maximum closing force to the suction valve assembly that is less than the rod load limit of a connecting rod coupled to the reciprocating element and the pump power end.

Embodiment N: The pump of any of Embodiment I through Embodiment M, wherein, when the suction valve assembly is not stuck in an open position at the end of the discharge stroke, a minimum distance between the suction valve assembly and the suction valve stop is greater than zero, such that the suction valve assembly does not contact the suction valve stop during normal operation of the pump.

Embodiment O: The pump of any of Embodiment I through Embodiment M, wherein, when the suction valve assembly is not stuck in an open position at the end of the discharge stroke, a minimum distance between the suction valve assembly and the suction valve stop is zero, such that the suction valve assembly contacts the suction valve stop with a closing force less than a rod load limit of a connecting rod coupled to the reciprocating element and the pump power end of the pump during normal operation of the pump.

Embodiment P: A method of servicing a wellbore, the method comprising: fluidly coupling a pump to a source of a wellbore servicing fluid and to the wellbore; and communicating wellbore servicing fluid into the wellbore via the pump, wherein the pump comprises a pump fluid end and a pump power end, wherein the pump fluid end comprises: a reciprocating element disposed at least partially within a reciprocating element bore of the pump fluid end; a discharge valve assembly; a suction valve assembly coupled with a front end of the reciprocating element; and a suction valve stop, wherein the suction valve stop is positioned within the reciprocating element bore such that the suction valve stop contacts the suction valve assembly when the suction valve assembly is stuck open at the end of a discharge stroke of the reciprocating element, and wherein the pump power end is operable to reciprocate the reciprocating element within the reciprocating element bore of the pump fluid end.

Embodiment Q: The method of Embodiment P, wherein the wellbore servicing fluid comprise a fracturing fluid, a cementitious fluid, a remedial fluid, a perforating fluid, a sealant, a drilling fluid, a spacer fluid, a completion fluid, a gravel pack fluid, a diverter fluid, a gelation fluid, a polymeric fluid, an aqueous fluid, an oleaginous fluid, or a combination thereof Embodiment R: The method of Embodiment P or Embodiment Q, wherein the wellbore servicing fluid comprises a diverting agent.

Embodiment S: The method of any of Embodiment P through Embodiment R, wherein suction valve assembly comprises a suction valve seat and a suction valve body, and wherein the wellbore servicing fluid comprises particles having an average dimension that is at least about 90, 95, or 100% of a distance between the suction valve seat and the suction valve body of the suction valve assembly when the suction valve assembly is in an open configuration.

Embodiment T: The method of any of Embodiment P through Embodiment S, wherein the pump operates during the pumping of the wellbore servicing fluid at a pressure of greater than or equal to about 3,000 psi, 5,000 psi, 10,000 psi, 20,000 psi, 30,000 psi, 40,000 psi, or 50,000 psi.

Embodiment U: The method of any of Embodiment P through Embodiment T, wherein the pump operates during the pumping of the wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Embodiment V: A method of preventing a suction valve assembly of a pump from being stuck open at an end of a discharge stroke of a reciprocating element within a reciprocating element bore of the pump when the pump is pumping a wellbore servicing fluid comprising particulates, the method comprising: providing a suction valve stop positioned within the reciprocating element bore of the pump such that, when the suction valve assembly is stuck open at the end of a discharge stroke of the reciprocating element, the suction valve stop contacts the suction valve assembly with a closing force to mechanically close the suction valve assembly.

Embodiment W: The method of Embodiment V, wherein the closing force is greater than a crush strength of the particulates and less than a rod load limit of a connecting rod coupled to the reciprocating element and a pump power end.

Embodiment X: A method of servicing a wellbore, the method comprising: fluidly coupling a pump to a source of a wellbore servicing fluid and to the wellbore; and communicating wellbore servicing fluid into the wellbore via the pump, wherein, during normal operation, on a suction stroke of the pump, wellbore servicing fluid is drawn into a pump chamber of the pump via a hollow portion of a reciprocating element of the pump, and a suction valve assembly of the pump is in an open position and a discharge valve assembly of the pump is in a closed position, wherein the suction valve assembly is coupled with a front of the reciprocating element; wherein, during normal operation, on a discharge stroke of the pump, wellbore servicing fluid is discharged from the pump chamber into a high pressure discharge chamber fluidly connected with the wellbore, and the suction valve assembly is in a closed configuration and the discharge valve assembly is in an open position; and wherein, if the suction valve assembly is stuck in an open configuration at the end of a discharge stroke, the suction valve assembly contacts a suction valve stop with a closing force that mechanically closes the suction valve assembly.

Embodiment Y: The method of Embodiment X, wherein the suction valve assembly is stuck in the open position at the end of the discharge stroke by a particulate material.

Embodiment Z1: The method of Embodiment X or Embodiment Y, wherein the closing force provided by the contacting of the suction valve stop with the suction valve assembly is greater than a crush strength of the particulate material.

Embodiment Z2: A method of preventing a suction valve assembly of a pump from being stuck open at an end of a discharge stroke of a reciprocating element within a reciprocating element bore of the pump when the pump is pumping a wellbore servicing fluid comprising particulates, the method comprising applying a mechanical force to a suction valve bod when the suction valve assembly is stuck open at the end of a discharge stroke of the reciprocating element y, wherein said mechanical force is greater than a crush strength of particular material contained within a wellbore servicing fluid being pumped and less than a load limit of a connecting rod that mechanically couples the reciprocating element to a crankshaft of a power end of the pump, and wherein the mechanical force closes the suction valve assembly.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method of servicing a wellbore, the method comprising:

fluidly coupling a pump to a source of a wellbore servicing fluid and to the wellbore; and communicating wellbore servicing fluid into the wellbore via the pump, wherein the pump comprises a pump fluid end and a pump power end, wherein the pump fluid end comprises:

a reciprocating element disposed at least partially within a reciprocating element bore of the pump fluid end;

a discharge valve assembly;

a suction valve assembly coupled with a front end of the reciprocating element; and a suction valve stop, wherein the suction valve stop is positioned within the reciprocating element bore such that the suction valve stop contacts the suction valve assembly when the suction valve assembly is stuck open at the end of a discharge stroke of the reciprocating element, and wherein the pump power end is operable to reciprocate the reciprocating element within the reciprocating element bore of the pump fluid end, and wherein, when the suction valve assembly is not stuck in an open position at an end of the discharge stroke, a minimum distance between the suction valve assembly and the suction valve stop is greater than zero, such that the suction valve assembly does not contact the suction valve stop during normal operation of the pump.

2. The method of claim 1, wherein the wellbore servicing fluid comprise a fracturing fluid, a cementitious fluid, a remedial fluid, a perforating fluid, a sealant, a drilling fluid, a spacer fluid, a completion fluid, a gravel pack fluid, a diverter fluid, a gelation fluid, a polymeric fluid, an aqueous fluid, an oleaginous fluid, or a combination thereof.

3. The method of claim 1, wherein suction valve assembly comprises a suction valve seat and a suction valve body, and wherein the wellbore servicing fluid comprises particulates having an average dimension that is substantially 90% to 100% of a distance between the suction valve seat and the suction valve body of the suction valve assembly when the suction valve assembly is in an open configuration.

4. The method of claim 3, wherein the suction valve assembly is stuck in the open position at the end of the discharge stroke by the particulates and wherein the closing force provided by the contacting of the suction valve stop with the suction valve assembly is greater than a crush strength of the particulates.

5. The method of claim 1, wherein the suction valve stop comprises a spring, a cushioned stop, a hard stop, or a combination thereof.

6. The method of claim 1, wherein the pump operates during the pumping of the wellbore servicing fluid at a pressure of substantially 3,000 psi to 50,000 psi, at a volumetric flow rate substantially in a range of from substantially 3 to substantially 20 barrels per minute (BPM), or a combination thereof.

7. The method of claim 1, wherein the suction valve assembly is stuck in the open position at the end of the discharge stroke by a particulate material, and wherein a closing force provided by the contacting of the suction valve stop with the suction valve assembly is greater than a crush strength of the particulate material.

8. The method of claim 1, wherein the pump fluid end is a concentric bore pump fluid end, wherein the discharge valve assembly and the suction valve assembly are coaxially aligned within the pump fluid end, and wherein the suction valve stop is coupled to the discharge valve assembly.

9. The method of claim 8, wherein the discharge valve assembly comprises a discharge valve seat and a discharge valve body, and wherein the suction valve stop is coupled to the discharge valve body on a side thereof proximate the reciprocating element.

10. The method of claim 1, wherein a rod load limit is substantially 200,000 to 300,000 lbf.

* * * * *